US010883351B2

(12) United States Patent
Andersen

(10) Patent No.: US 10,883,351 B2
(45) Date of Patent: Jan. 5, 2021

(54) APPARATUS FOR TRANSFERRING A RECIPROCATING MOVEMENT FROM A SURFACE MACHINERY TO A DOWNHOLE DEVICE AND A METHOD OF PRODUCING WELL FLUIDS

(71) Applicant: Norali AS, Mathopen (NO)

(72) Inventor: Gunnar Andersen, Mathopen (NO)

(73) Assignee: Norali AS, Mathopen (NO)

( * ) Notice: Subject to any disclaimer, the term of this patent is extended or adjusted under 35 U.S.C. 154(b) by 223 days.

(21) Appl. No.: 16/137,586

(22) Filed: Sep. 21, 2018

(65) Prior Publication Data

US 2019/0234192 A1 Aug. 1, 2019

(30) Foreign Application Priority Data

Jan. 30, 2018 (NO) ..... 20180149

(51) Int. Cl.

| | |
|---|---|
| ***E21B 43/12*** | (2006.01) |
| ***E21B 47/009*** | (2012.01) |
| ***E21B 47/06*** | (2012.01) |
| ***F04B 47/02*** | (2006.01) |

(52) U.S. Cl.

CPC ..... *E21B 43/127* (2013.01); *E21B 43/126* (2013.01); *E21B 47/009* (2020.05); *E21B 47/06* (2013.01); *F04B 47/022* (2013.01)

(58) Field of Classification Search

CPC ..... E21B 43/126; E21B 43/127; F04B 47/08; F04B 47/10; F04B 9/117–9/1178

USPC ..... 417/385, 386

See application file for complete search history.

(56) References Cited

U.S. PATENT DOCUMENTS

| | | | | | |
|---|---|---|---|---|---|
| 1,761,081 | A * | 6/1930 | Leschen | F04B 47/04 | 417/378 |
| 1,797,245 | A * | 3/1931 | Schaer | F04B 9/107 | 417/387 |
| 1,802,790 | A * | 4/1931 | Squires | F04B 47/04 | 417/378 |
| 1,946,723 | A * | 2/1934 | Thompson | F04B 47/08 | 417/378 |
| 2,058,455 | A * | 10/1936 | Huff | F04B 47/08 | 417/378 |
| 2,527,184 | A * | 10/1950 | Gerhold | F04B 9/105 | 417/264 |
| 4,026,661 | A | 5/1977 | Roeder | | |
| 4,616,981 | A * | 10/1986 | Simmons | F04B 47/08 | 417/378 |

(Continued)

*Primary Examiner* — Blake E Michener

(74) *Attorney, Agent, or Firm* — Christian D. Abel

(57) ABSTRACT

The invention relates to an apparatus for transferring a reciprocating movement from a machinery arranged at a surface to a device located downhole in a subterranean well, the apparatus comprising:

a longitudinal hollow body an upper rod connected to the machinery in one end thereof and to an upper displacement body in another end thereof, a lower displacement body adapted to operate the device, the upper displacement body and the lower displacement body are in communication via a liquid in the longitudinal hollow body, and are movable within the longitudinal hollow body, and wherein the upper displacement body, the lower displacement body and the liquid are configured to reciprocate synchronously relative to the longitudinal hollow body.

The invention further relates to a method of producing a wellbore fluid.

8 Claims, 26 Drawing Sheets

(56) References Cited

U.S. PATENT DOCUMENTS

| | | | | |
|---|---|---|---|---|
| 5,785,500 | A | 7/1998 | Leniek | |
| 2004/0194964 | A1* | 10/2004 | Tieben | E21B 43/127 166/369 |
| 2009/0285700 | A1* | 11/2009 | Corbeil | F04B 47/08 417/390 |
| 2012/0114510 | A1 | 5/2012 | Brown | |
| 2012/0211237 | A1* | 8/2012 | Rich | E21B 43/126 166/369 |
| 2014/0079560 | A1* | 3/2014 | Hodges | E21B 43/126 417/15 |
| 2015/0136418 | A1* | 5/2015 | Garrett | F04B 47/04 166/378 |

* cited by examiner

APPARATUS FOR TRANSFERRING A RECIPROCATING MOVEMENT FROM A SURFACE MACHINERY TO A DOWNHOLE DEVICE AND A METHOD OF PRODUCING WELL FLUIDS

FIELD OF THE INVENTION

The invention relates to an apparatus for transferring a reciprocating movement from a machinery arranged at a surface to a device located downhole in a subterranean well as well as a method of producing well fluids.

BACKGROUND OF THE INVENTION

Previously is known a mechanical sucker rod for transferring the reciprocating movement from any surface mounted pump unit to any type of a downhole reciprocating pump. Previously known is also a multitude of reciprocating downhole pumps, all with the drive mechanism attached to the top of the reciprocating downhole pump. This technology of a sucker rod and a downhole reciprocating pump was introduced at the infancy of the oil and gas industry when the industry started producing oil from wellbores. Prior to that, the basic principle of the technology was used for lifting water from water wells. The very first and primitive systems have been around for thousands of years, and the first systems were manually driven, i.e. manual labour provided the reciprocating movement required to operate the downhole pump system. Currently the oil & gas industry typically employ three main types of surface mounted pump units for driving the downhole reciprocating pumps. The most commonly know is the Beam Pumping Unit (also called Pump Jacks), but over the past decades the industry has introduced the Linear Vertical Mechanical Pumping Unit, and also the Hydraulic Pumping Unit. The latter is supplied either as a skid mounted unit or as a wellhead mounted unit.

The mechanical sucker rods used to drive the reciprocating downhole pumps are typically made of different types of steel. The type of steel used, and the size/diameter of the sucker rod is based on the design criteria for each particular well. There are three main grades of steel (Grade C, Grade K and Grade D) used in sucker rods, and these have different steel compositions and tensile strength. In addition, the industry today also uses fibre-reinforced plastic (FRP) sucker rods normally made from protruded fibreglass which is less subjected to corrosion. Attempts have also been made on manufacturing and employing a plastic-coated wire (flexible strand) in combination with weight bars to operate reciprocating downhole pumps. Finally, there is also continuous solid rod which have been used by the industry. What characterizes these different solutions is that they are purely mechanical.

Reciprocating downhole pumps have been set as deep as 5.000 meters, which is rather special, because normally these pumps are employed at depths from 3.000 meter and shallower. The shallow wells may be just a few hundred meters, and these shallow set pumps may produce some 4-5.000 barrels of oil per day (bbl/d). The deeper set pumps have less lifting capacity and may produce 500 bbl/d or less.

Some of the advantages of the reciprocating downhole pumps or sucker rod pumps, which is another term for the same pump system, is their long lifetime. In addition, these pumps are easy to operate, they are fairly easy to repair and within certain limits it is easy to change their lifting capacity, i.e. the produced volume (bbl/d). The disadvantages for these systems is their limited setting depth caused by the mechanical properties and weight of the sucker rod. Also, particularly in deviated wells, both the tubing and the sucker rod itself is subjected to wear by the continuous reciprocating movement of the rod itself as it is in physical contact with the tubing.

Common to all sucker rod pump solution is the need to decrease lifting costs, increase the production rate and optimize the power consumption. This could also be summarized as increased or optimised energy efficiency. The workload to be handled by the surface mounted pump unit, be it a Beam Pumping Unit (also called Pump Jacks), a Linear Vertical Mechanical Pumping Unit or a Hydraulic Pumping Unit which is driving the reciprocating downhole pump, can be divided into two phases. During the up stroke the surface mounted pump unit must lift the weight of the produced fluid, it must also lift the weight of the sucker rod minus the buoyancy effect caused by the oil and/or water surrounding the sucker rod. In addition, every time the sucker rod changes direction from a downward movement to an upward stroke, the system is subjected to acceleration forces. Finally, the friction forces between the sucker rod and the tubing wall and between the produced fluid and the tubing wall must be handled by the surface mounted pump unit. The downward movement of the sucker rod is simply generated by the gravity forces. To conserve the energy generated by gravity, and use that conserved energy to reduce the kinetic energy required for the upward movement, the surface mounted pump units are equipped with weights.

The reciprocating downhole pump is a very old invention, it is also a fairly simple design and each manufacturer normally have their own variations to their specific design features. The reciprocating pump is anchored to the very bottom of the tubing. The pump normally comprises a standing valve system at the inlet of the pump which is at the bottom of the pump. Then there is the housing of the pump, inside which there is a pump barrel. Inside the pump barrel there is a reciprocating pump plunger, which is equipped with a travelling valve system. The plunger is then connected to the sucker rod. And, at the top of the housing of the pump there is an outlet into the tubing. When the pump is operated, the pump plunger moves from the bottom of the pump barrel and upwards, and thereby moving fluids upwards into the tubing when at the same time filling the pump barrel with wellbore fluids. The hydrostatic fluid pressure in the wellbore, i.e. outside the pump, is sufficient to open the standing valve system and let the wellbore fluids enter the pump barrel. When the pump plunger has traveled to the top of the pump barrel, a travelling movement driven by the sucker rod, which again is driven by the surface mounted pump unit, the pump plunger starts its downward movement. When the plunger moves downward the standing valve system is forced to close and the travelling valve system is forced to open. These forces are caused by the wellbore fluids trapped inside the pump barrel. The fluids inside the pump barrel is then moved into the plunger.

In one design the reciprocating downhole pump is a type called hydraulic piston double-acting pump. In this design the hydraulic fluid is pumped from a surface unit down to the pump and thereby moving an engine piston up and down inside the pump. The hydraulic fluid is discharged into the tubing. The engine piston operates a shaft which pushes a pump piston up and down the pump barrel. Both during the upstroke and the downstroke of the pump piston, wellbore fluids are entering into the pump barrel and thereafter being discharged into the tubing, hence the double-action. There is similarly a design called hydraulic piston single-acting pump.

The U.S. Pat. No. 5,785,500 describes a pump system using a hydraulic fluid to operate a downhole plunger and thereby a set of valves to pump fluids from a wellbore to the surface. A surface mounted hydraulic pump operates the downhole plunger, hence there are no sucker rods employed by this system.

SUMMARY OF THE INVENTION

The invention is defined by the main claim, while the dependent claims indicate alternative embodiments of the invention.

The hydraulic pump rod, in combination with one or more mechanical sucker rods or a pump shaft, transfers the reciprocating movement from any surface mounted pump unit to any type of a reciprocating downhole pump. Also, the hydraulic pump rod in combination with one or more mechanical sucker rods and a pump shaft, transfers the reciprocating movement from any surface mounted pump unit to an inverted reciprocating downhole pump. The hydraulic pump rod, and thereby also any reciprocating downhole pump or any inverted reciprocating downhole pump, can be deployed and set to operate in subterranean wells with any deviation from the vertical (0° deviation) to the horizontal (90° deviation). The hydraulic pump rod has reduced weight and mechanical friction compared to a purely mechanical sucker rod. In addition, the hydraulic pump rod, which is confined within a hydraulic pipe, can be bent 180° downhole. By employing this feature, a hydraulic pump rod can be used to drive an inverted reciprocating downhole pump. The hydraulic pump rod may consist of one or more fluids with similar or different density and/or rheology. The invented hydraulic pump rod and the invented hydraulic pump rod in combination with an inverted reciprocating downhole pump can be deployed and used in wells producing oil, oil and water, hence also in wells producing oil, water and some gas, provided the gas is handled according to industry standards for downhole reciprocating pumps. In addition, the inventions can be deployed and used in wells producing water for human consumption, agricultural purposes, or geothermal energy.

It is described an apparatus for transferring a reciprocating movement from a machinery arranged at a surface to a device located downhole in a subterranean well, the apparatus comprising:

- a longitudinal hollow body
- an upper rod connected to the machinery in one end thereof and to an upper displacement body in another end thereof,
- a lower displacement body adapted to operate the device,
- the upper displacement body and the lower displacement body are in communication via a liquid in the longitudinal hollow body, and are movable within the longitudinal hollow body, and
- wherein the upper displacement body, the lower displacement body and the liquid are configured to reciprocate synchronously relative to the longitudinal hollow body.

In an aspect, the apparatus further comprises a hydraulic tube, which hydraulic tube in one end thereof is connected to the longitudinal hollow body and in another end is connected to a hydraulic monitoring and pressure adjustment unit, and wherein the pressure in the liquid can be monitored and adjusted by the hydraulic monitoring and pressure adjustment unit.

In an aspect, the upper rod is a sucker rod.

In an aspect, the lower displacement body is connected to a lower rod, such as a sucker rod or a pump shaft.

In an aspect, the device is an inverted reciprocating downhole pump and the lower rod is a pump shaft connected to the inverted reciprocating downhole pump.

In an aspect, the device is an inverted reciprocating downhole pump and the lower displacement body is a pump piston in the inverted reciprocating downhole pump.

In an aspect, the device is a reciprocating downhole pump and the pump shaft is connected to the reciprocating downhole pump.

In an aspect, the apparatus further comprises at least a first stuffing box, and wherein the upper rod runs through the first stuffing box.

In an aspect, the apparatus further comprises a second stuffing box, and wherein the lower rod runs through the second stuffing box.

In an aspect, the upper displacement body and/or the lower displacement body and/or the upper rod is in connection with a kinetic energy storing unit.

In an aspect, the lower rod and/or the reciprocating downhole pump and/or the inverted reciprocating downhole pump is equipped with a kinetic energy storing unit.

In an aspect, the device is an inverted reciprocating downhole pump and the longitudinal hollow body is equipped with a bend, e.g. the longitudinal hollow body comprises a U-tube portion.

In an aspect, the inverted reciprocating downhole pump is equipped with radial standing valves.

In an aspect, the connection between the inverted reciprocating downhole pump and the longitudinal hollow body is equipped with a lower stroke volume and one or more inlet(s)/outlet(s) for communication with surrounding wellbore fluids.

It is further described a method of producing a wellbore fluid utilizing an apparatus, the apparatus comprises a longitudinal hollow body, an upper rod connected to the machinery in one end thereof and to an upper displacement body in an opposite end, a lower displacement body adapted to operate the device, wherein the method comprises the following steps:

- operating the machinery arranged at the surface to cyclic move the upper rod to reciprocate relative the longitudinal hollow body,
- transferring the reciprocating movement of the upper rod to a reciprocating movement of a liquid in the longitudinal hollow body,
- transferring the reciprocating movement of the liquid to the lower displacement body and thus the device, wherein the upper displacement body, the lower displacement body and the liquid are configured to reciprocate synchronously relative to the longitudinal hollow body.

In general, it is described an apparatus comprising a longitudinal hollow body. The longitudinal hollow body is preferably a hydraulic pipe filled with a liquid. This particular setup is also referred to as "hydraulic pump rod" in the application. The longitudinal hollow body is to be employed in a wellbore with the purpose of contributing to lifting the produced wellbore fluids from any subterranean well to the surface. Thus, in the application, the term 'hydraulic pump rod' shall be understood as a device with similar functions as a mechanical pump rod, without mechanical connections but where a liquid replaces the mechanical pump rod. This liquid can be any mainly incompressible fluids, such as any type of water, treated water, oil or any other hydraulic fluid or any kind of fluid that can be used as a hydraulic fluid, specially treated or not. One possible treatment of the liquid could be to add shear thinning chemicals. The liquid, and thereby the hydraulic pump rod, may be designed with different density, viscosity and compressibility from one subterranean well to another. Also, the hydraulic pump rod may, in any given subterranean well, be composed of different combinations of liquids with different densities and rheological characteristics. In one embodiment of the invention the hydraulic pump rod may contain suspended particles i.e. solids, be it nanoparticles or particles in the range defined as micron sizes. The liquid, i.e. the hydraulic pump rod, is placed in a confined space. The confined space is given by a longitudinal hollow body, such as a hydraulic pipe, in the radial/cross-sectional direction. The cross-sectional area of the hydraulic pipe would normally be of a circular shape, but it may also be manufactured in any other shape, such as oval, elliptical, polygonal etc. The hydraulic pipe, which is one type of a longitudinal hollow body with any given length, may consist of different cross-sectional shapes over the length of the hydraulic pipe. Furthermore, the physical strength of the hydraulic pipe may be increased by employing ribs or by reducing the cross-sectional area and employing more than one hydraulic pipe in a bundle. The pipe wall of the hydraulic pipe (longitudinal hollow body) can be mechanically stiff in the same way as the pipe wall of any other type of pipes or tubing normally used in wells, and can be a coiled tubing, snubbing pipe, drill pipe, tubing or casing being employed in a subterranean well. This means that the hydraulic pipe also can be subjected to any type of dogleg found in a deviated subterranean well. In the axial/longitudinal direction of the hydraulic pipe, the confined volume of the hydraulic pump rod is given by an upper displacement body and a separate lower displacement body. In one embodiment of the invention the upper and lower displacement body may for example be in the form of a piston or a plunger or a combination of the two, i.e. the upper displacement body could be a plunger while the lower displacement body could be a piston or vice versa. In one embodiment of the invention the upper displacement body may be an inflatable device. No matter the physical form of the upper and lower displacement body, their function is to displace the liquid being the hydraulic pump rod inside the hydraulic pipe (longitudinal hollow body) during the reciprocating movement of the machinery at surface, e.g. a surface mounted pump unit. The surface mounted pump unit can in fact one type of reciprocating machinery installed at the surface. In one embodiment of the invention, an inverted pump piston with direct hydraulic drive may replace the lower displacement body to give a confined space for the hydraulic pump rod. To prevent contamination of the upper and lower displacement bodies by debris from wellbore fluids, the top of the hydraulic pipe may in one embodiment of the invention be equipped with an upper downhole stuffing box, i.e. a first stuffing box, while the bottom of the hydraulic pipe may be equipped with a lower downhole stuffing box, i.e. a second stuffing box. In one embodiment of the invention the upper displacement body, which is hydraulically connected to the hydraulic pump rod, may be located above the surface, while in another embodiment of the invention the upper displacement body may be located downhole in the wellbore of a subterranean well.

To monitor, and possibly adjust the pressure in the hydraulic pump rod, the hydraulic pipe can be connected to a surface mounted hydraulic monitoring and pressure adjustment unit using e.g. a hydraulic tube or any other means suitable for the operation. This hydraulic tube, connecting the hydraulic pipe to the surface mounted monitoring and pressure adjustment unit, is preferably filled with the same liquid as the hydraulic pump rod, i.e. the liquid inside the longitudinal hollow body, itself. This surface mounted monitoring and pressure adjustment unit may be configured to, at all times or continuously, adjust the pressure in the hydraulic pump rod, and thereby adjust the mechanical/hydraulic properties of the hydraulic pump rod, i.e. the liquid in the longitudinal hollow body. The surface mounted monitoring and pressure adjustment unit may be equipped with the necessary gauges and valves to monitor and adjust the condition of the hydraulic pump rod.

The hydraulic pump rod will reciprocate, i.e. move up and down, relative to the hydraulic pipe/longitudinal hollow body. The upper displacement body, which is mechanically connected to an upper rod such as a sucker rod, and thereby moved up and down by any type of a surface mounted pump unit, is hydraulically connected to the top of the hydraulic pump rod (i.e. the liquid in the longitudinal hollow body). The upper displacement body is therefore causing the hydraulic pump rod (i.e. the liquid) to move relative to the hydraulic pipe. At the bottom the hydraulic pump rod is hydraulically connected to either a lower displacement body or an inverted pump piston with direct hydraulic drive. The lower displacement body may be connected to a lower rod such as a sucker rod which then again is connected to a reciprocating downhole pump, the reciprocating downhole pump is one type of a device located downhole in a subterranean well. In one embodiment of the invention the lower displacement body may be connected to a pump shaft, be it a pump shaft in a reciprocating downhole pump or an inverted reciprocating downhole pump. The surface machinery (e.g. surface mounted pump), the upper rod (e.g. sucker rod), the upper displacement body, the hydraulic pump rod (the liquid in the longitudinal hollow body) and the lower displacement body, or in one embodiment of the invention the inverted pump piston, will reciprocate synchronously. However, since the hydraulic pump rod, i.e. the liquid in the longitudinal hollow body, always will have a small compressibility, there may be some small delays in the synchronicity in reciprocating the movement of the upper displacement body, the hydraulic pump rod and the lower displacement body or the inverted pump piston, still the reciprocating movement should be defined as synchronously.

Any type of a surface machinery (e.g. a surface mounted pump unit) causes, through its mechanical connection to the upper displacement body via a upper rod (e.g. one or more sucker rods), the upward movement of the hydraulic pump rod (liquid in the longitudinal hollow body). Gravity causes the downward movement of the hydraulic pump rod (liquid in the longitudinal hollow body). In one embodiment of the invention, a kinetic energy storing unit is utilized to store the excess gravity induced kinetic energy generated by the downward movement of the hydraulic pump rod. This stored kinetic energy is released during the upward movement of the hydraulic pump rod, and will thereby assist in the upward movement. The kinetic energy storing unit may in one embodiment of the invention be placed above or below the upper displacement body and/or above or below the lower displacement body. The kinetic energy storing unit may also alternatively be placed in connection with the reciprocating downhole pump or the inverted reciprocating downhole pump as long as the kinetic energy storing unit is charged by the gravity forces generated by the downward movement of the hydraulic pump rod. In fact, there may be more than one kinetic energy storing unit installed in the system. No matter where in the downhole part of the system the kinetic energy storing unit is placed, its purpose is to assist in the upward movement of the hydraulic pump rod and thereby reduce the energy consumption of surface mounted pump unit. In one embodiment of the invention the kinetic energy storing unit may be a mechanical spring designed and dimensioned for that particular well. However, other technologies for storing kinetic energy may also be employed as a kinetic energy storing unit, including the compression of a gas.

The hydraulic pump rod is indifferent to the deviation of the wellbore in which it is installed. Likewise, the hydraulic pump rod in theory can be used in any shape or form since it is a liquid being moved up and down inside a hydraulic pipe (longitudinal hollow body). The hydraulic pipe, and therefore also the hydraulic pump rod, may be connected to the top part of any type of reciprocating downhole pump as is a normal in the industry today when a sucker rod is used to operate the reciprocating downhole pump. However, due to the physical nature of the hydraulic pump rod, it may in one embodiment of the invention be attached to the bottom side of any type of an inverted reciprocating downhole pump when employing a 180° bend (U-turn) in the hydraulic pipe.

When the hydraulic pipe, and therefore also the hydraulic pump rod, is connected to the top part of any type of reciprocating downhole pump, the hydraulic pipe will be mounted concentric to the tubing. When the hydraulic pipe is concentric to the tubing, one or more anchors may be used to lock the hydraulic pipe to the inside of the tubing. However, in one embodiment of the invention, when the hydraulic pump rod and the hydraulic pipe is connected to the bottom section of an inverted reciprocating downhole pump, the hydraulic pipe is mounted in parallel to the tubing in the subterranean well, and the tubing and the hydraulic pipe is run separately to the surface. In one embodiment of the invention, when the hydraulic pump rod and the hydraulic pipe is connected to the bottom section of an inverted reciprocating downhole pump, the hydraulic pipe and the tubing can be joined together using a Y-connection. When the Y-connection is employed, the hydraulic pipe is run concentric to the tubing above the Y-connection and all the way to the surface. The Y-connection may be placed at any depth as long as the Y-connection is located above the top of the inverted reciprocating downhole pump. When the hydraulic pipe is mounted parallel to the tubing, one or more clamps may be used to lock the tubing and the hydraulic pipe to one another.

Furthermore, in general, this invention also describes a hydraulic pump rod connected to the bottom of an inverted reciprocating downhole pump. In this embodiment of the invention the hydraulic pipe and thereby also the hydraulic pump rod is equipped with a 180° bend (i.e. a U-turn) at the bottom of any subterranean well. This 180° bend is located close to the producing intervals of that subterranean well. In one embodiment of this invention the hydraulic pump rod is hydraulically connected to an inverted pump piston. When the hydraulic pump rod is connected to the bottom side of an inverted pump piston, the inverted pump piston is per definition also a lower displacement body in addition to being a pump piston. In another embodiment the hydraulic pump rod is hydraulically connected to lower displacement body which is mechanically connected to a pump shaft which again is mechanically connected to an inverted pump piston or plunger.

In one embodiment of the invention of the hydraulic pump rod in combination with an inverted reciprocating downhole pump, a lower rod comprising a pump shaft, instead of a lower rod comprising a sucker rod, could be connected to the plunger of a standard reciprocating downhole pump. In this embodiment of the invention the standard reciprocating downhole pump would be installed upside down compared to its normal use. When a standard reciprocating downhole pump is used in connection with this invention, some modification to the standing valve system and the traveling valve system is required considering the fact that the standard reciprocating downhole pump is mounted upside down in the subterranean well. In this embodiment of the invention the pump shaft is mechanically connected to a lower displacement body while the lower displacement body is hydraulically connected to the hydraulic pump rod.

In one embodiment of the invention of the hydraulic pump rod in combination with an inverted reciprocating downhole pump, the inverted reciprocating downhole pump could be equipped with a radial standing valve system allowing wellbore fluids to enter the pump cylinder or the pump barrel. The radial standing valve system could be mounted at the top of the inverted reciprocating downhole pump, i.e. in a position where the radial standing valve system would not be influenced by the stroke length of the inverted pump piston or plunger. In this embodiment of the invention the piston or plunger will not be equipped with any valves.

In one embodiment of the invention of the hydraulic pump rod in combination with an inverted reciprocating downhole pump, the inverted reciprocating downhole pump could be equipped with an inverted pump piston or plunger being equipped with inverted travelling valve system allowing wellbore fluids to enter the pump cylinder or the pump barrel.

In one embodiment of the invention of the hydraulic pump rod in combination with an inverted reciprocating downhole pump, the system could be equipped with a lower stroke volume in which either the inverted pump piston/plunger or the lower displacement body reciprocates. This lower stroke volume should not be filled with a liquid since the liquid has very low compressibility which would restrict the reciprocating movement.

In one embodiment of the invention of the hydraulic pump rod in combination with an inverted reciprocating downhole pump, the system could be equipped with an inverted standing valve system at the top of the inverted reciprocating downhole pump. The inverted standing valve system shall allow produced wellbore fluids to enter the tubing, but also prevent the produced wellbore fluids from flowing back down into the inverted reciprocating downhole pump.

In one embodiment of the invention of the hydraulic pump rod in combination with an inverted reciprocating downhole pump, the inverted reciprocating downhole pump system could be equipped with one or more kinetic energy storing units. The kinetic energy storing unit(s) could be charged, i.e. put in tension, either by compression or stretching. However, no matter the placement or charging method of the kinetic energy storing unit, the purpose of the kinetic energy storing is to assist in the upward movement of any surface mounted pump unit with the purpose of reducing the energy consumption of the surface mounted pump unit. Throughout the description and claims, different wording has been used for describing the same element or elements with similar functionality. Thus, the different wording shall be understood to have the same meaning, including:

longitudinal hollow body=hydraulic pipe, liquid in longitudinal hollow body=hydraulic pump rod, upper rod=mechanical connection between upper displacement body and machinery at surface, lower rod=mechanical connection between lower displacement body and downhole device.

These and other non-limiting embodiments of the invention will be explained with reference to the drawings, in which:

DETAILED DESCRIPTION OF THE INVENTION

Figure 1:
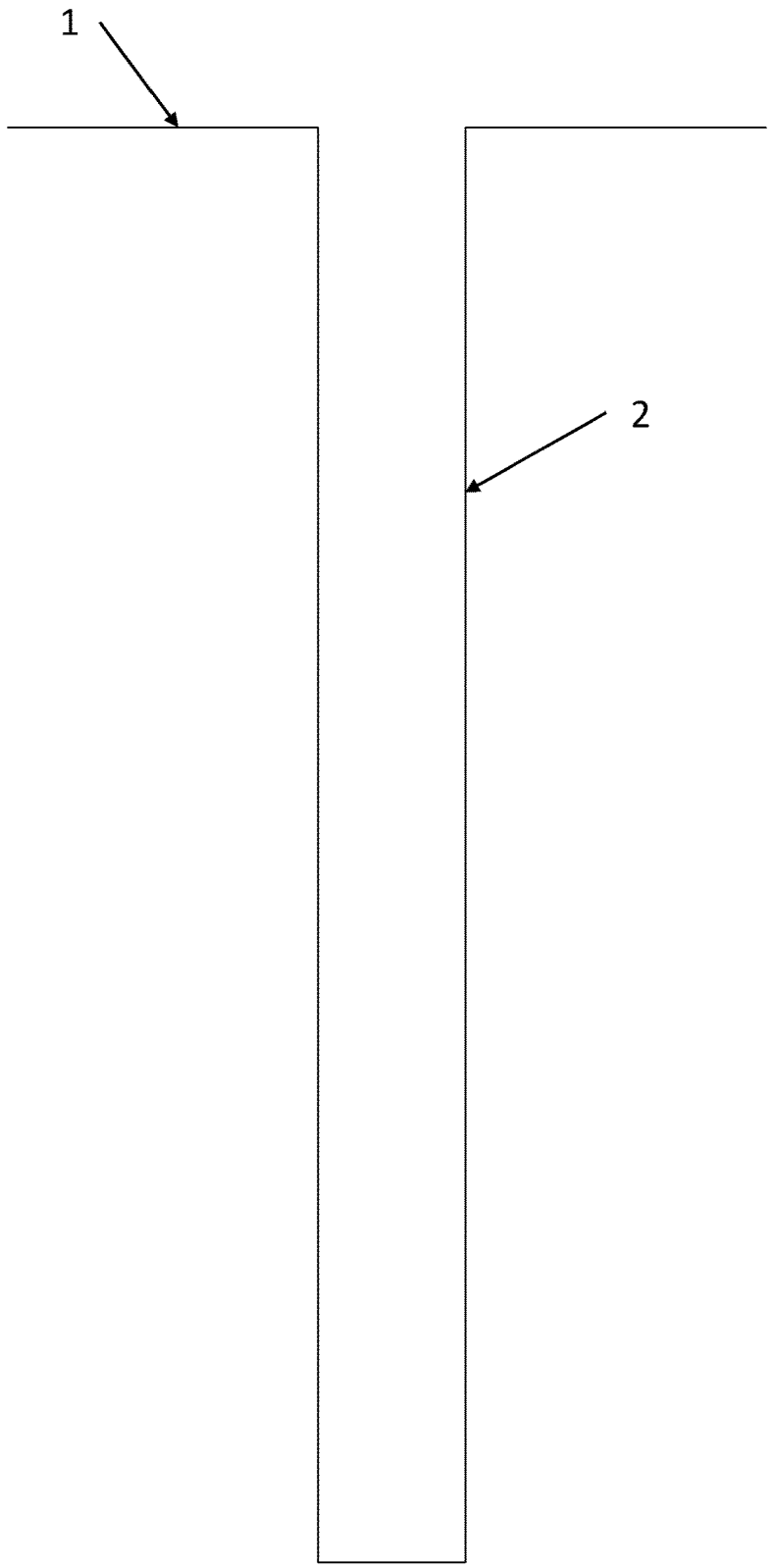
FIG. 1 shows a cross-sectional side view of a subterranean vertical well.

FIG. 1 shows a principle sketch of any type of a subterranean vertical well 2 drilled from any kind of a surface 1 be it land, seabed, or any type of platform.

Figure 2:
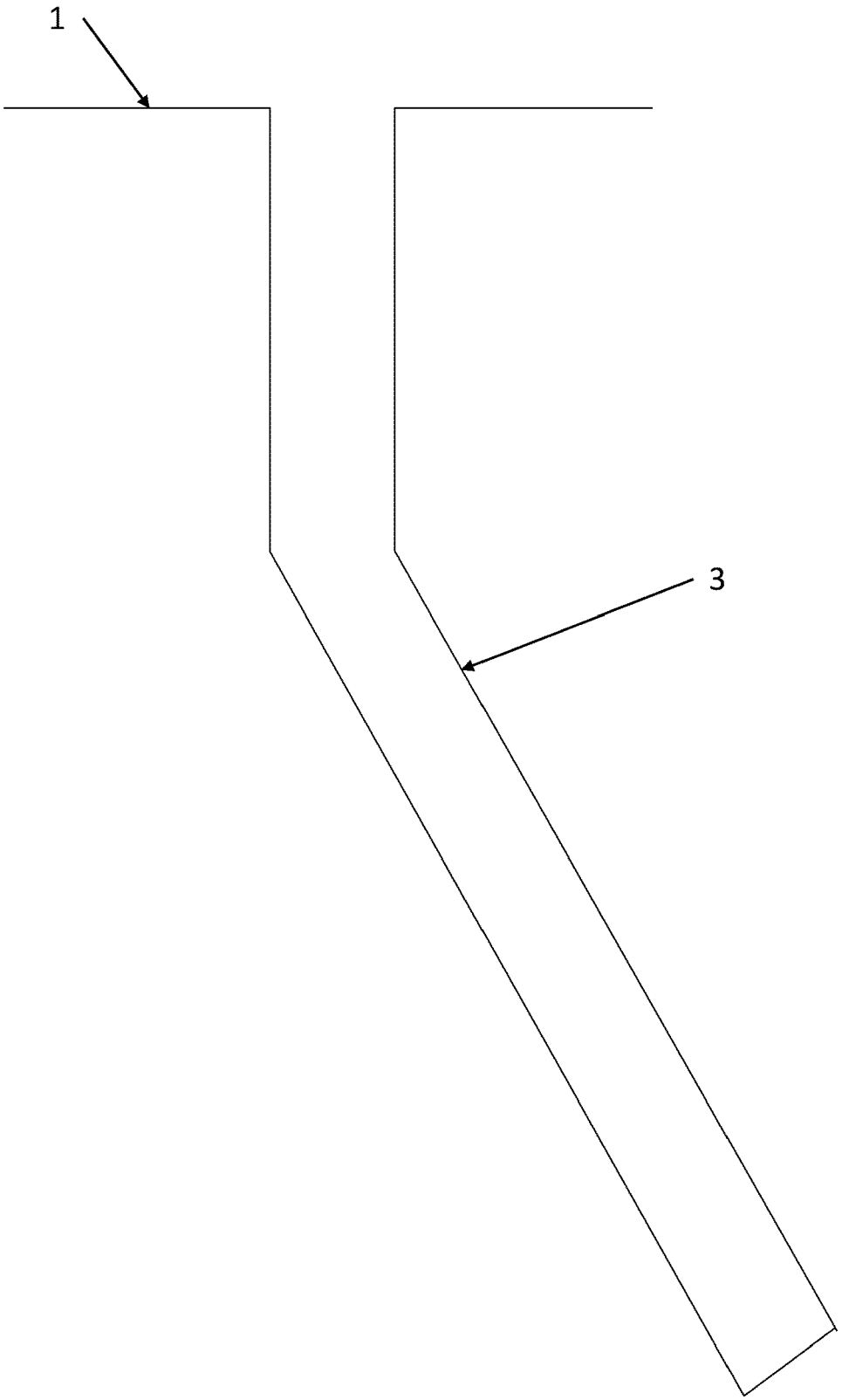
FIG. 2 shows a cross-sectional side view of a subterranean deviated well.

FIG. 2 shows a principle sketch any type of a subterranean deviated well 3 drilled from any kind of a surface 1 be it land, seabed, or any type of platform. The angle of the subterranean deviated well 3 could be any angle from the vertical (0° deviation) to the horizontal plane (90° deviation).

Figure 3:
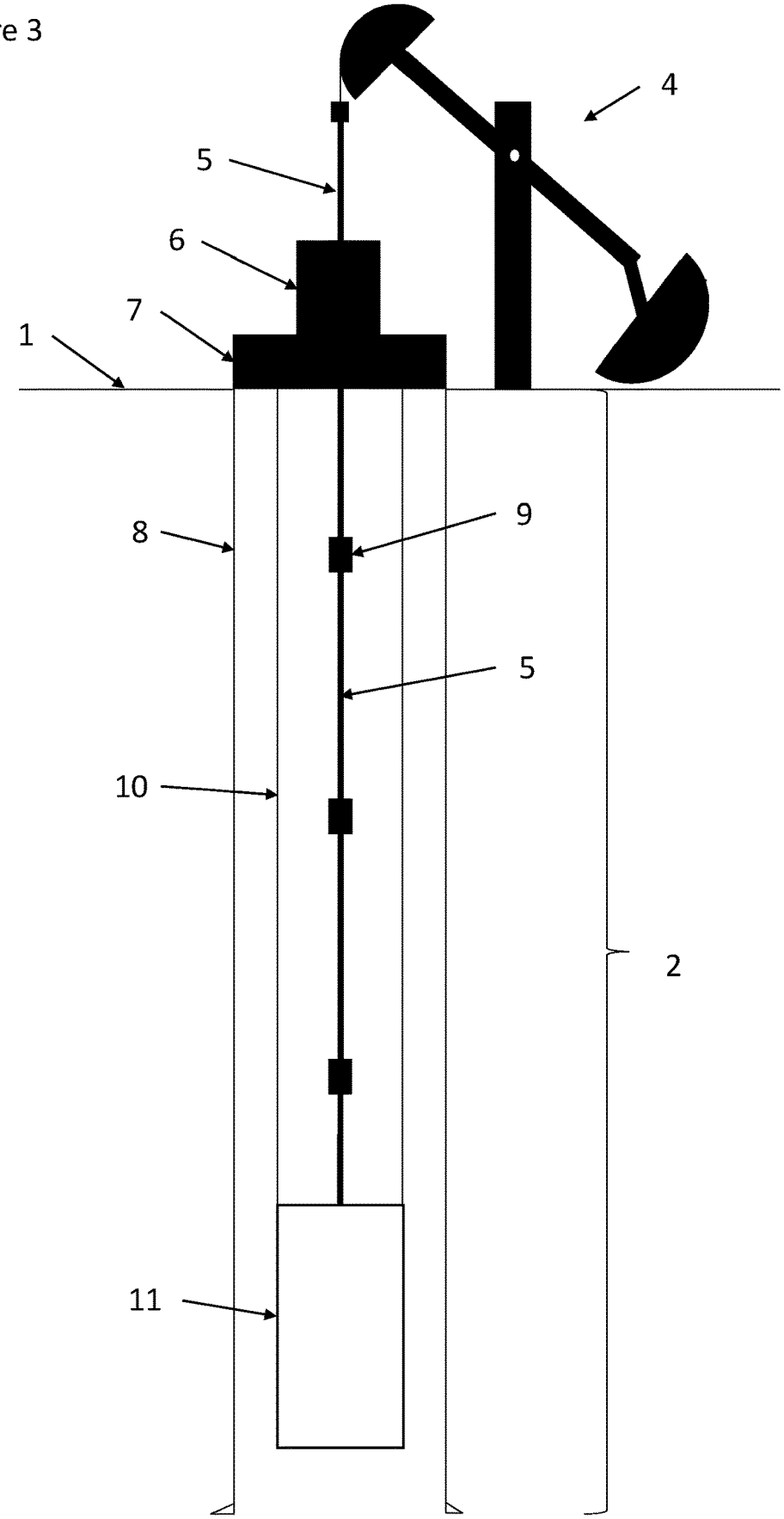
FIG. 3 shows a cross-sectional side view of a subterranean vertical well equipped with a traditional beam pump at surface, a sucker rod and a reciprocating downhole pump according to a typical prior art solution.

FIG. 3 shows a principle sketch of a beam pump 4 installed at the surface 1, where the beam pump 4 is connected to a sucker rod 5. The sucker rod 5 runs through a X-mas tree 6 which is installed on the top of the wellhead 7. A casing 8 and a tubing 10 is installed in the subterranean vertical well 2, and at the surface 1 the casing 8 and the tubing 10 are terminated at the wellhead 7. The sucker rod 5, which runs through the X-mas tree 6, is made from multiple joints which are connected to one another through rod connections 9. The sucker rod 5 runs all the way to the reciprocating downhole pump 11 which is hung off at the end of the tubing 10. When the beam pump 4 is operating, it moves the sucker rod 5 up and down in a reciprocating manner. This reciprocating movement, caused by the beam pump 4, is transferred all the way from the surface 1 to the reciprocating downhole pump 11 by the sucker rod 5. In that respect FIG. 3 shows a typical previously known completion employing a sucker rod 5 and a reciprocating downhole pump 11.

Figure 4:
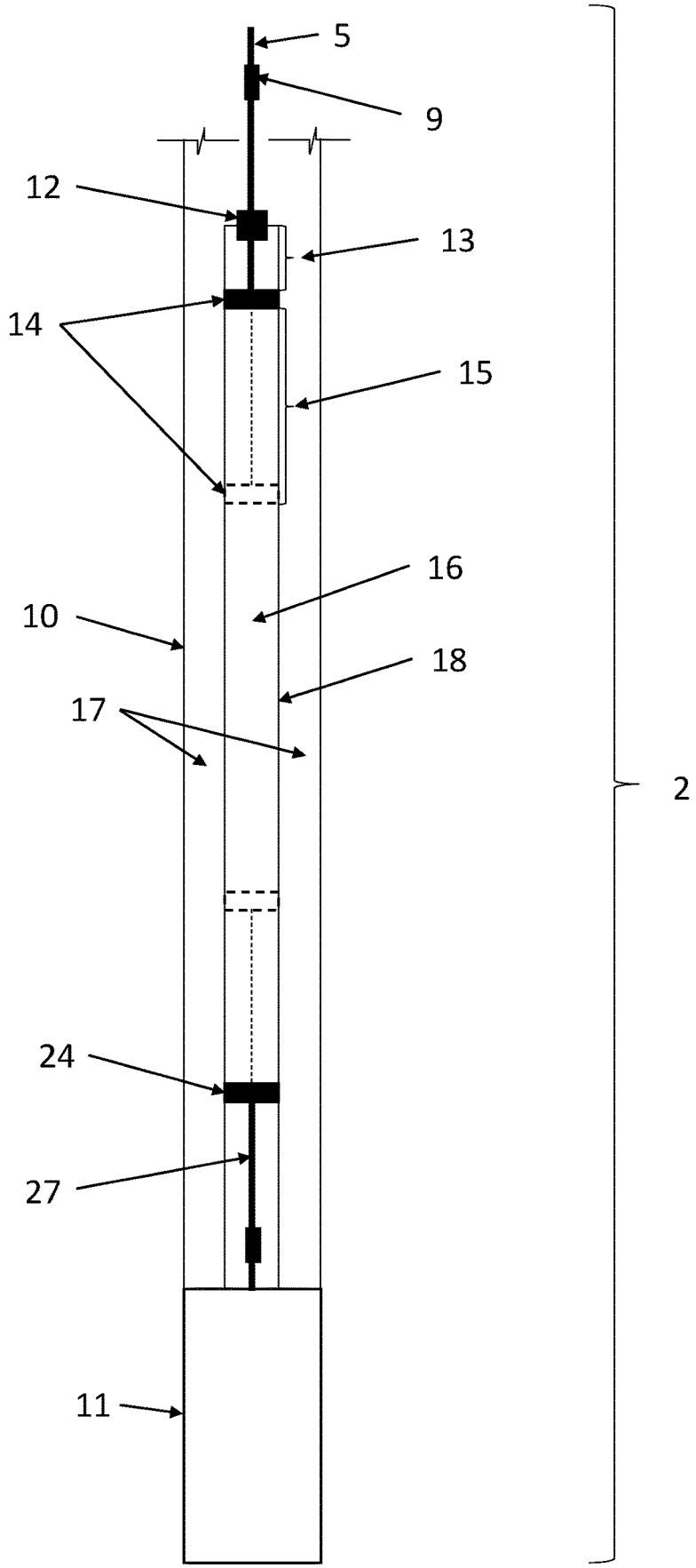
FIG. 4 shows a cross-sectional side view of a section of a subterranean vertical well equipped with a section of a sucker rod, a hydraulic pump rod and a reciprocating downhole pump.

FIG. 4 shows a principle sketch of a cross-sectional side view of a section of a subterranean vertical well 2 shown with a section of a an upper rod in the form of a sucker rod 5 mechanically connected to the topside of an upper displacement body 14. At its bottom, the upper displacement body 14 is hydraulically connected a hydraulic pump rod (i.e. a liquid) 16. The hydraulic pump rod 16, which could consist of any type of water, treated water or any other hydraulic fluid which could be specially treated or not, is in the radially and axially directions confined by a hydraulic pipe (i.e. longitudinal hollow body) 18. The hydraulic pipe 18 is in this FIG. 4 shown to be installed concentric to the tubing 10, thus proving an annular production area 17 outside the hydraulic pipe 18 and inside the tubing 10. The annular production area 17 leads the produced fluids from the downhole device exemplified as a reciprocating downhole pump 11 towards the surface 1. At the very bottom, the hydraulic pipe 18, is connected to the reciprocating downhole pump 11. The reciprocating downhole pump 11 is connected to a lower rod exemplified as a lower sucker rod 27 and a lower displacement body 24. In this FIG. 4 the hydraulic pipe 18 is equipped with an upper downhole stuffing box 12, i.e. a first stuffing box. This upper downhole stuffing box 12 has the sucker rod 5 passing through it, and as the sucker rod 5 is reciprocated the upper downhole stuffing box 12 cleans the sucker rod 5 and keep contamination out of the upper stroke volume 13. When the sucker rod 5 reciprocates the upper stroke volume 13 will change in size, hence the upper downhole stuffing box 12 must not trap any liquid pressure. When the sucker rod 5 reciprocates, its stroke length is equal to the stroke length of the surface machinery, e.g. surface mounted pump unit (not shown in FIG. 4) to which the sucker rod 5 is connected. The stroke length 15 of the upper displacement body 14 is also equal to the stroke length of the surface mounted pump unit because the upper displacement body 14 is mechanically connected to the sucker rod 5. Therefore, the upper stroke volume 13 and the stroke length 15 of the upper displacement body 14 will vary in length as the sucker rod 5 reciprocates. This reciprocating motion of the sucker rod 5 is transferred to the upper displacement body 14 which transfers it to the hydraulic pump rod 16 which again transfers it to the lower displacement body 24 which is mechanically connected to the lower sucker rod 27. The lower sucker rod 27 is mechanically connected to the reciprocating downhole pump 11. The hydraulic pump rod (liquid) 16 thereby has a reciprocating movement relative to the hydraulic pipe 18 which is not moving at all during pumping operations, i.e. the reciprocating movements.

Figure 5:
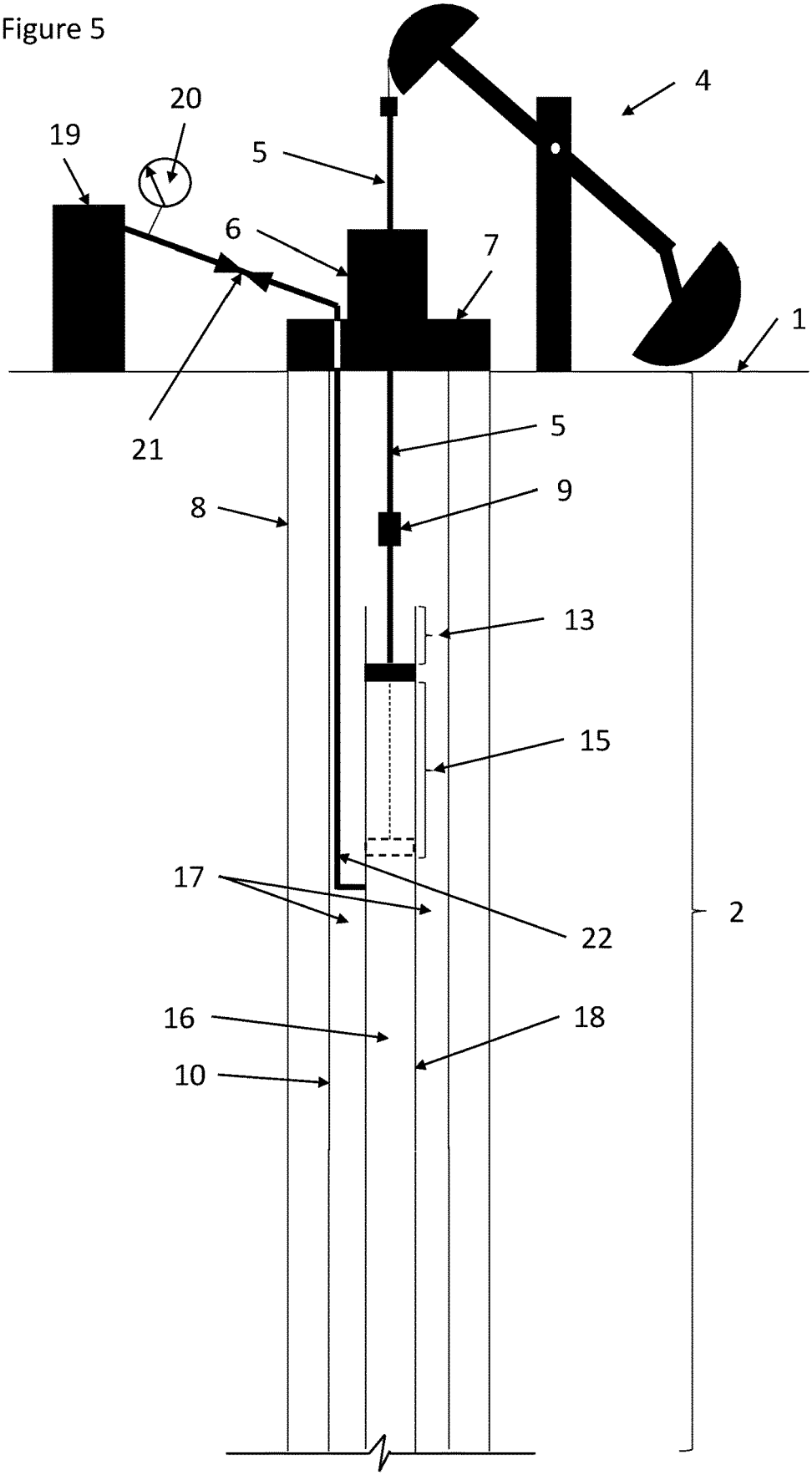
FIG. 5 shows a cross-sectional side view of a section of a subterranean vertical well equipped with a beam pump, a partial sucker rod solution, a hydraulic pump rod and a surface mounted hydraulic monitoring and pressure adjustment unit.

FIG. 5 shows a principle sketch of cross-sectional side view of a section of a subterranean vertical well 2 equipped with a surface machinery exemplified as a beam pump 4. An upper rod exemplified as a sucker rod 5, with rod connection 9, runs from the beam pump 4 to the upper displacement body 14. As the beam pump 4 moves up and down, the upper displacement body 14 moves up and down, and thereby the upper stroke volume 13 and changes as the upper displacement body 14 moves within the stroke length 15 of the upper displacement body 14. In this FIG. 5 the very top of the hydraulic pipe 18 is not equipped with an upper downhole stuffing box 12. The hydraulic pipe 18 is in FIG. 5 connected to a hydraulic tube 22 somewhere below the stroke length 15 of the upper displacement body 14. This hydraulic tube 22 runs all the way through the wellhead 7 to the surface 1. At the surface 1 the hydraulic tube 22 is terminated in a hydraulic monitoring and pressure adjustment unit 19. By the use of the hydraulic tube 22 and at least one pressure gauge 20, the hydraulic monitoring and pressure adjustment unit 19 can monitor and adjust the pressure inside the hydraulic pipe 18 and the hydraulic pump rod (liquid) 16 at all times. At the surface 1 the hydraulic monitoring and pressure adjustment unit 19 can be equipped with at least one valve 21 which can isolate the hydraulic tube 22 and thereby also the hydraulic pipe 18 and the hydraulic pump rod 16 from the hydraulic monitoring and pressure adjustment unit 19. In this FIG. 5 the subterranean vertical well 2 is equipped with hydraulic pump rod 16. Although not shown in FIG. 5, the hydraulic pump rod is connected to a lower displacement body which again is connected to a downhole pump. Also, a tubing 10 is shown in this FIG. 5 together with the annular production area 17. Finally, in FIG. 5 is shown a X-mass tree 6, through which the sucker rod 5 runs. Also shown is a tubing 10 and a casing 8 which is terminated at the wellhead 7.

Figure 6:
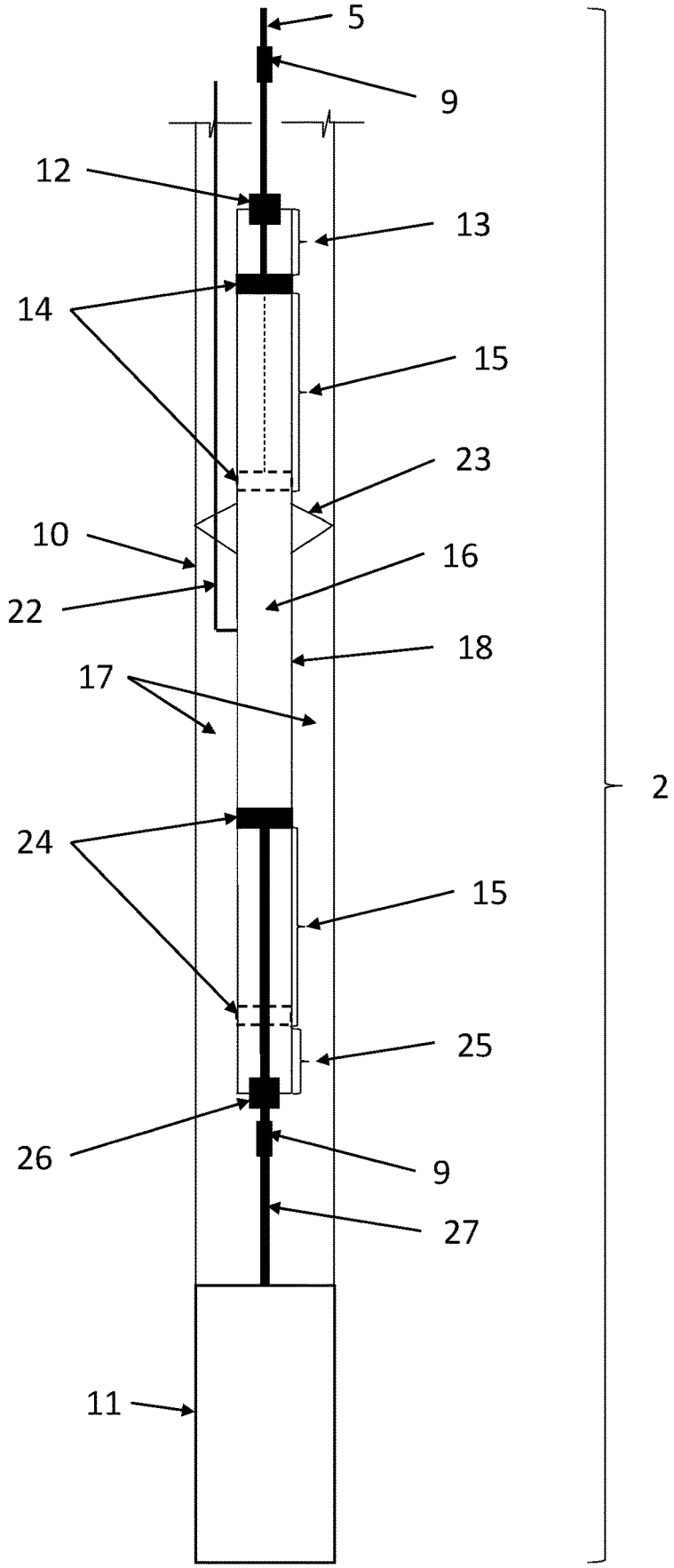
FIG. 6 shows a cross-sectional side view of a section of a subterranean vertical well equipped an upper displacement body, a hydraulic pump rod, a lower displacement body and a reciprocating downhole pump.

FIG. 6 shows a principle sketch of a cross-sectional side view of a section of a subterranean vertical well 2 shown with a section of an upper rod exemplified as a sucker rod 5 equipped with a rod connection 9. The sucker rod 5 is connected to any type of surface machinery, e.g. a surface mounted reciprocating pump unit (not shown in this FIG. 6). The sucker rod 5 is mechanically connected to the top of the upper displacement body 14. The upper displacement body 14 is at its bottom hydraulically connected to the hydraulic pump rod (liquid) 16. The hydraulic pump rod 16 is confined within the hydraulic pipe (longitudinal hollow body) 18 which is equipped with a hydraulic tube 22. In this FIG. 6 the hydraulic pipe 18 is installed concentric to the tubing 10, thus providing an annular production area 17 outside the hydraulic pipe 18 and inside the tubing 10. The bottom part of the hydraulic pump rod 16 is hydraulically connected to the top of the lower displacement body 24. At its bottom, the lower displacement body 24 is mechanically connected to a lower rod exemplified as a lower sucker rod 27. The lower sucker rod 27 may be equipped with rod connections 9. The number of rod connections 9 depends on the distance from the bottom of the hydraulic pipe 18 to the reciprocating downhole pump 11. The lower sucker rod 27 is at its bottom connected to a device in the form of a reciprocating downhole pump 11, which is hung off at the bottom of the tubing 10. Since the hydraulic pipe 18 in this FIG. 6 is not mechanically connected to the reciprocating downhole pump 11, the hydraulic pipe 18 is hung of in the tubing 10 using an anchor 23. Therefore, when a surface mounted reciprocating pump unit, not shown in this FIG. 6, is reciprocating, the hydraulic pipe 18 is stationary while the sucker rod 5, the upper displacement body 14, the hydraulic pump rod 16, the lower displacement body 24, the lower sucker rod 27 and the internal parts of the reciprocating downhole pump 11 is moving up and down. Also, when a surface mounted reciprocating pump unit, not shown in this FIG. 6, is reciprocating, the stroke lengths 15 will change in length and both the upper stroke volume 13 and the lower stroke volume 25 will change in volume. Due to the changes in the upper stroke volume 13 and also the lower stroke volume 25, the upper downhole stuffing box 12, i.e. first stuffing box, and the lower downhole stuffing box 26, i.e. the second stuffing box, must not trap any liquid or pressure caused by a liquid. However, during reciprocation the upper downhole stuffing box 12 must clean the upper rod, i.e. the upper sucker rod 5, while the lower stuffing box 26 must clean the lower rod, i.e. the lower sucker rod 27. When the reciprocating downhole pump 11 is operated, it takes wellbore fluids from its outside, i.e. the subterranean well in which it is installed (not shown in. FIG. 6) and moves the wellbore fluids through itself (i.e. through the pump) and into the tubing 10, then the wellbore fluids are passing through the annular production area 17 outside the hydraulic pipe 18, before the wellbore fluids are moved all the way to the surface 1 (not shown in FIG. 6).

Figure 7:
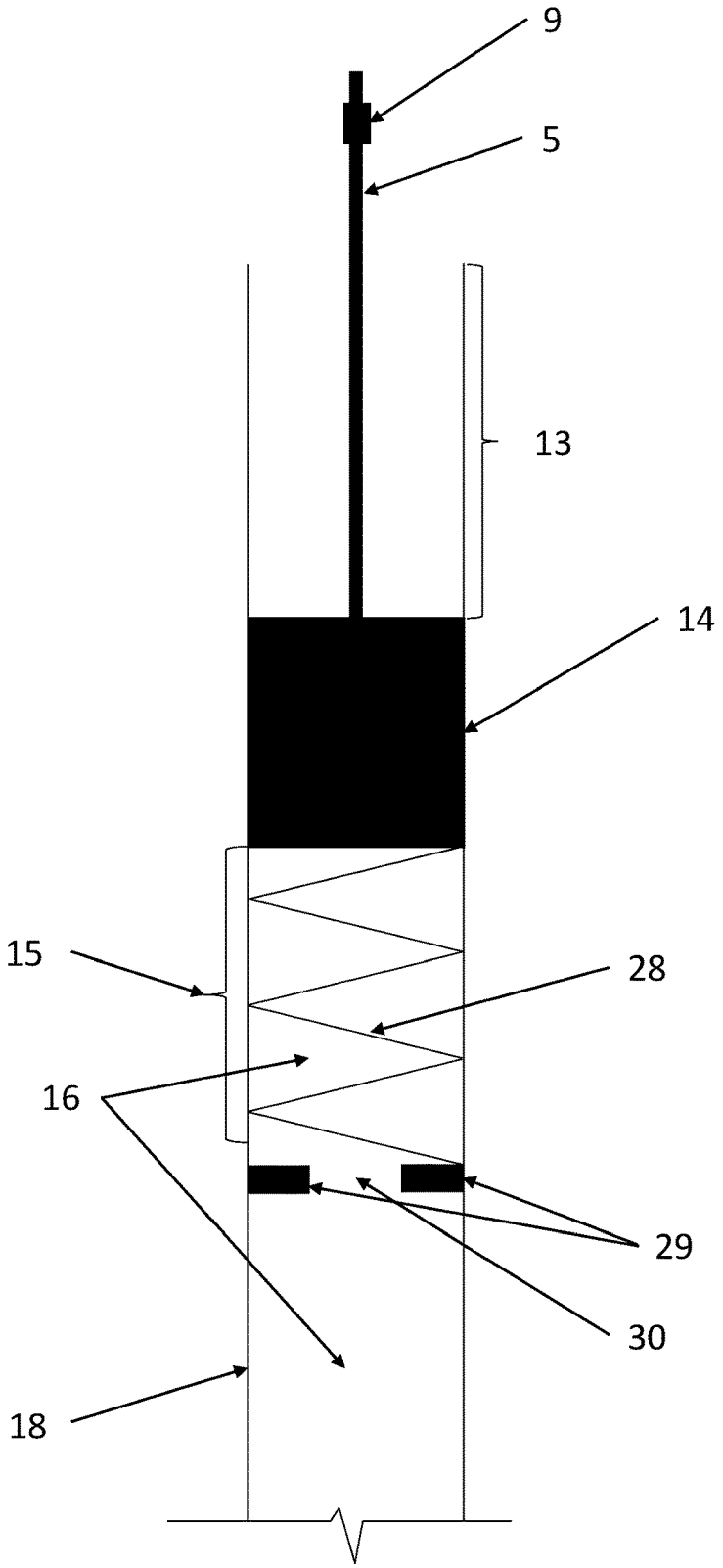
FIG. 7 shows a cross-sectional side view of an upper displacement body equipped with a kinetic energy storing unit installed below the upper displacement body.

FIG. 7 shows a principle sketch of cross-sectional side view of an upper displacement body 14, and in this FIG. 7 the upper displacement body 14 is equipped with a kinetic energy storing unit 28 in the form of a mechanical spring. The kinetic energy storing unit 28 is located inside the hydraulic pipe 18, between the bottom of the upper displacement body 14 and a floor 29. The floor 29 is equipped with an opening 30 allowing the liquid that constitutes the hydraulic pipe 16, to pass through the floor 29. The floor 29 is placed at a level below the stroke length 15 of the upper displacement body 14, thus the floor 29 will not interfere with the reciprocating movement of the upper rod exemplified as sucker rod 5, and the upper displacement body 14. When the sucker rod 5, the upper displacement body 14 and the hydraulic pump rod 16 move downward, the kinetic energy storing unit 28, which in this FIG. 7 is in the form of a mechanical spring, is compressed towards the floor 29. This compression is caused by the gravity forces, and the compression energy is stored in the kinetic energy storing unit 28. When the sucker rod 5, the upper displacement body 14 and the hydraulic pump rod 16 move upward caused by the upward movement of a surface mounted reciprocating pump unit (not shown in FIG. 7) the compression energy stored in the kinetic energy storing unit 28 is released. This released energy reduces the energy that must be supplied from any surface energy supply system during the upward movement of a surface mounted reciprocating pump unit (not shown in FIG. 7).

Figure 8:
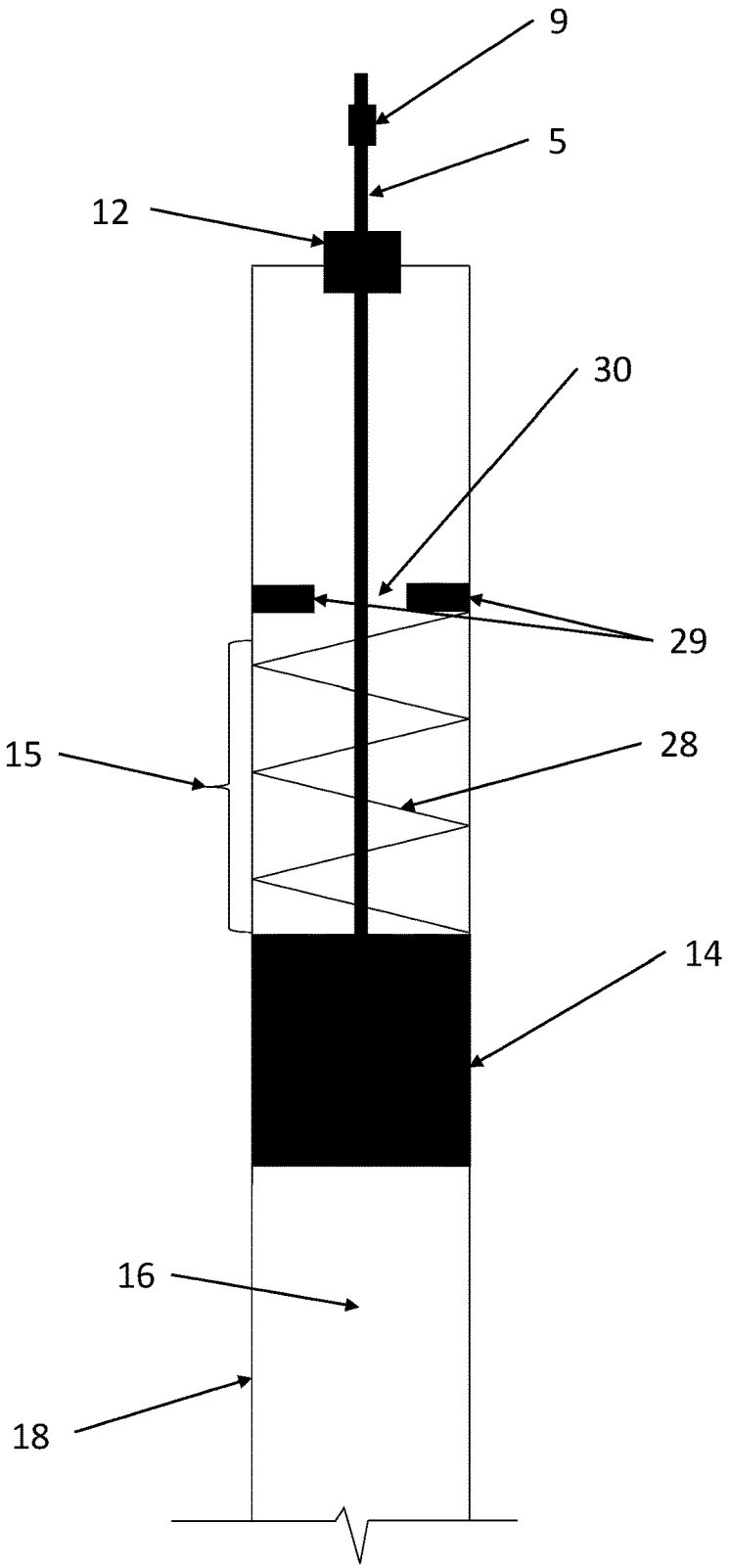
FIG. 8 shows a cross-sectional side view of an upper displacement body equipped with a kinetic energy storing unit installed above the upper displacement body.

FIG. 8 shows a principle sketch of cross-sectional side view of an upper displacement body 14, and in this FIG. 8 the upper displacement body 14 is equipped with a kinetic energy storing unit 28 in the form of a mechanical spring. The kinetic energy storing unit 28 is located inside the hydraulic pipe (longitudinal hollow body) 18, between the top of the upper displacement body 14 and a floor 29. The floor 29 is equipped with an opening 30 allowing any type of fluids to pass through the floor 29. The floor 29 is placed at a level above the stroke length 15 of the upper displacement body 14, thus the floor 29 will not interfere with the reciprocating movement of the sucker rod 5 and the upper displacement body 14. When the sucker rod 5, the upper displacement body 14 and the hydraulic pump rod 16 moves downward, the kinetic energy storing unit 28 is stretched between the floor 29 and the upper displacement body 14. This stretching is caused by the gravity forces, and this stretching sets up a tension energy which is stored in the kinetic energy storing unit 28. When the upper rod exemplified as sucker rod 5, the upper displacement body 14 and the hydraulic pump rod 16 move upward caused by the upward movement of a surface mounted reciprocating pump unit (not shown in FIG. 8) the tension, generated by the gravity forces during the downstroke and stored in the kinetic energy storing unit 28, is released. This released energy reduces the energy that must be supplied from any surface energy supply system during the upward movement of a surface mounted reciprocating pump unit (not shown in FIG. 8). In this FIG. 8 the hydraulic pipe 18 is shown to be equipped with an upper downhole stuffing box 12.

Figure 9:
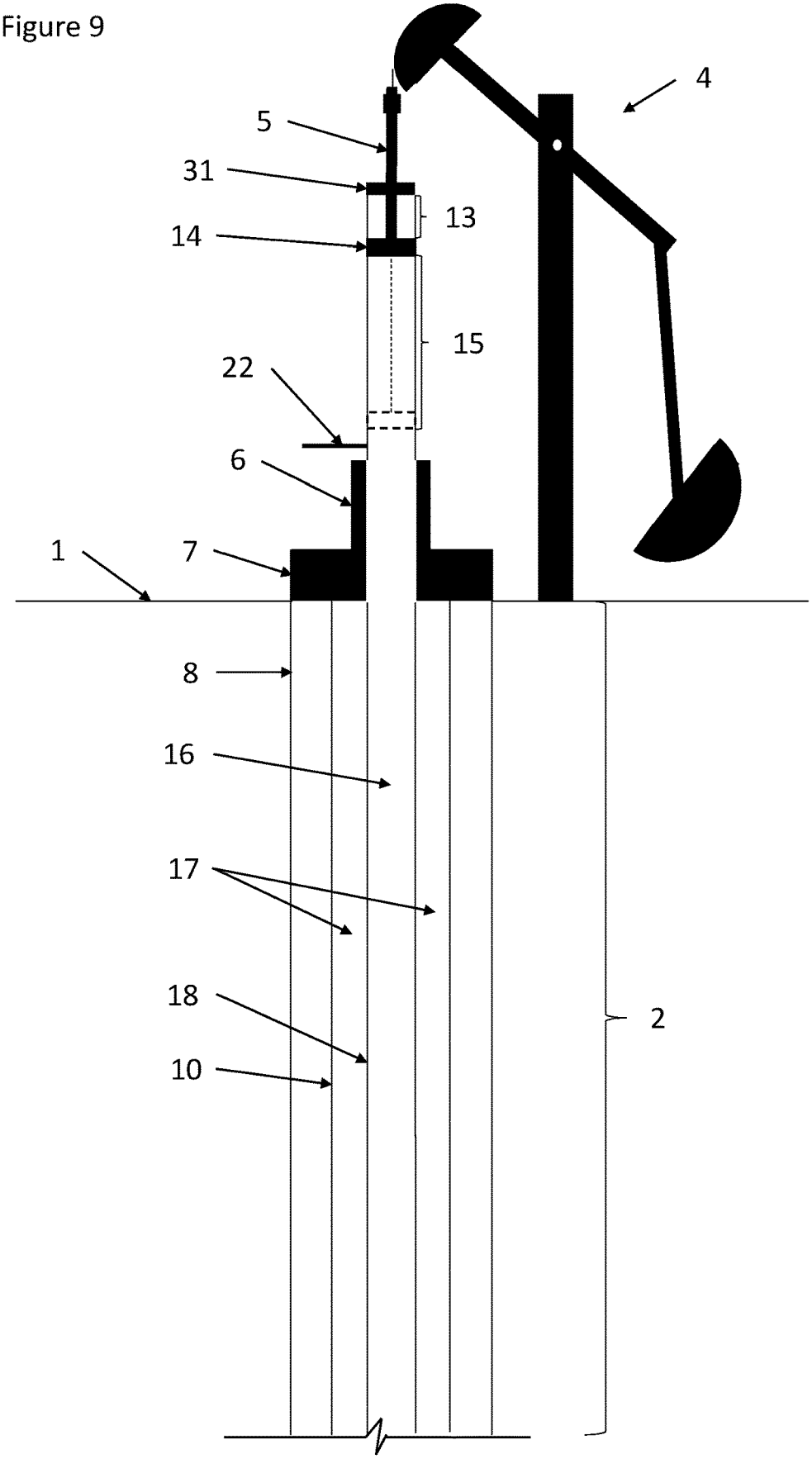
FIG. 9 shows a cross-sectional side view of a section of a subterranean vertical well equipped with a beam pump, a partial sucker rod solution, a hydraulic pump rod and a hydraulic tube for a surface mounted hydraulic monitoring and pressure adjustment unit.

FIG. 9 shows a principle sketch of cross-sectional side view of a section of subterranean vertical well 2 equipped with a surface machinery exemplified as a beam pump 4. In this FIG. 9 the hydraulic pipe 18 extends above the surface 1 and runs all the way down to a reciprocating downhole pump (not shown in FIG. 9), meaning that the hydraulic pipe 18 also passes through the X-mass tree 6 and the wellhead 7. In this FIG. 9 the hydraulic pipe (longitudinal hollow body) 18 is equipped with a standard stuffing box 31, i.e. a first or second stuffing box. In this FIG. 9 also the hydraulic pump rod 16 extends above the surface 1, meaning that the upper displacement body 14 also is placed above the surface 1 which leads to the fact that the reciprocating movement of the upper rod exemplified as sucker rod 5 and the upper displacement body 14 has a stroke length 15 which is above the surface 1. The hydraulic pipe 18 in this FIG. 9 is connected to a hydraulic tube 22 somewhere below the stroke length 15 of the upper displacement body 14 and above the X-mass tree 6. The hydraulic tube 22 is connected to a hydraulic monitoring and pressure adjustment unit 19, which is not shown in FIG. 9. Also shown in FIG. 9 is the tubing 10, the casing 8 and the annular production area 17 which in this FIG. 9 is shown to lead the produced fluids to the surface 1.

Figure 10:
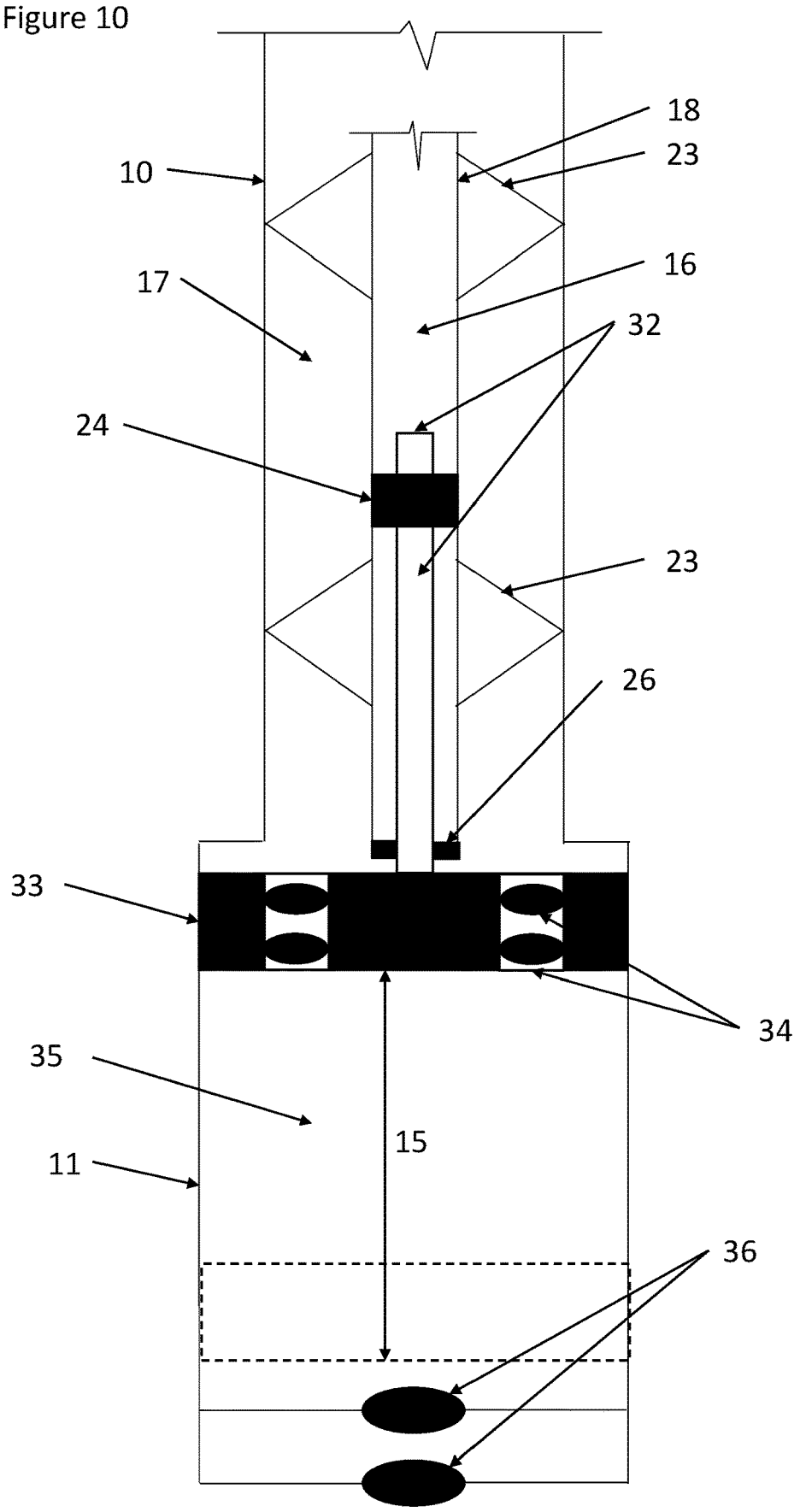
FIG. 10 shows a cross-sectional side view of a hydraulic pump rod hydraulically connected to a lower displacement body which is mechanically connected to a pump shaft which again is mechanically connected to a pump piston in a reciprocating downhole pump.

FIG. 10 shows a principle sketch of cross-sectional side view of a hydraulic pump rod (liquid) 16 and a device exemplified as a reciprocating downhole pump 11. In this FIG. 10 the hydraulic pump rod 16 is hydraulically connected to a lower displacement body 24 which again is mechanically connected to a lower rod exemplified as a pump shaft 32. The pump shaft 32 is mechanically connected to a pump piston 33 which is equipped with two sets of travelling valves 34. The pump shaft 32 may be, but not shown in FIG. 10, connected to any type of a reciprocating downhole pump 11. When the hydraulic pump rod 16, the lower displacement body 24 and the pump shaft 32 reciprocates up and down, also the pump piston 33 moves up and down a given stroke length 15. The stroke length 15 is determined by the stroke length of the surface mounted reciprocating pump unit (not shown in FIG. 10). As the pump piston 33 moves down, the travelling valves 34 open while the standing valves 36 at the bottom of the reciprocating downhole pump 11, i.e. at the bottom of the pump cylinder 35, are closed. Thus, the wellbore fluids in the pump cylinder 35 is forced from the bottom side of the pump piston 33 to the top side of the pump piston 33. Then, when the pump piston 33 moves upward, the traveling valves 34 are closed and thereby forcing the wellbore fluids in the pump cylinder 35 above the pump piston 33 into the annular production area 17. At the same time the standing valves 36 open and allow a new volume of wellbore fluids from the subterranean well outside the reciprocating downhole pump 11 to enter the pump cylinder 35 below the pump piston 33. In this FIG. 10 the hydraulic pipe 18 hung off in the tubing 10 with an anchor 23.

Figure 11:
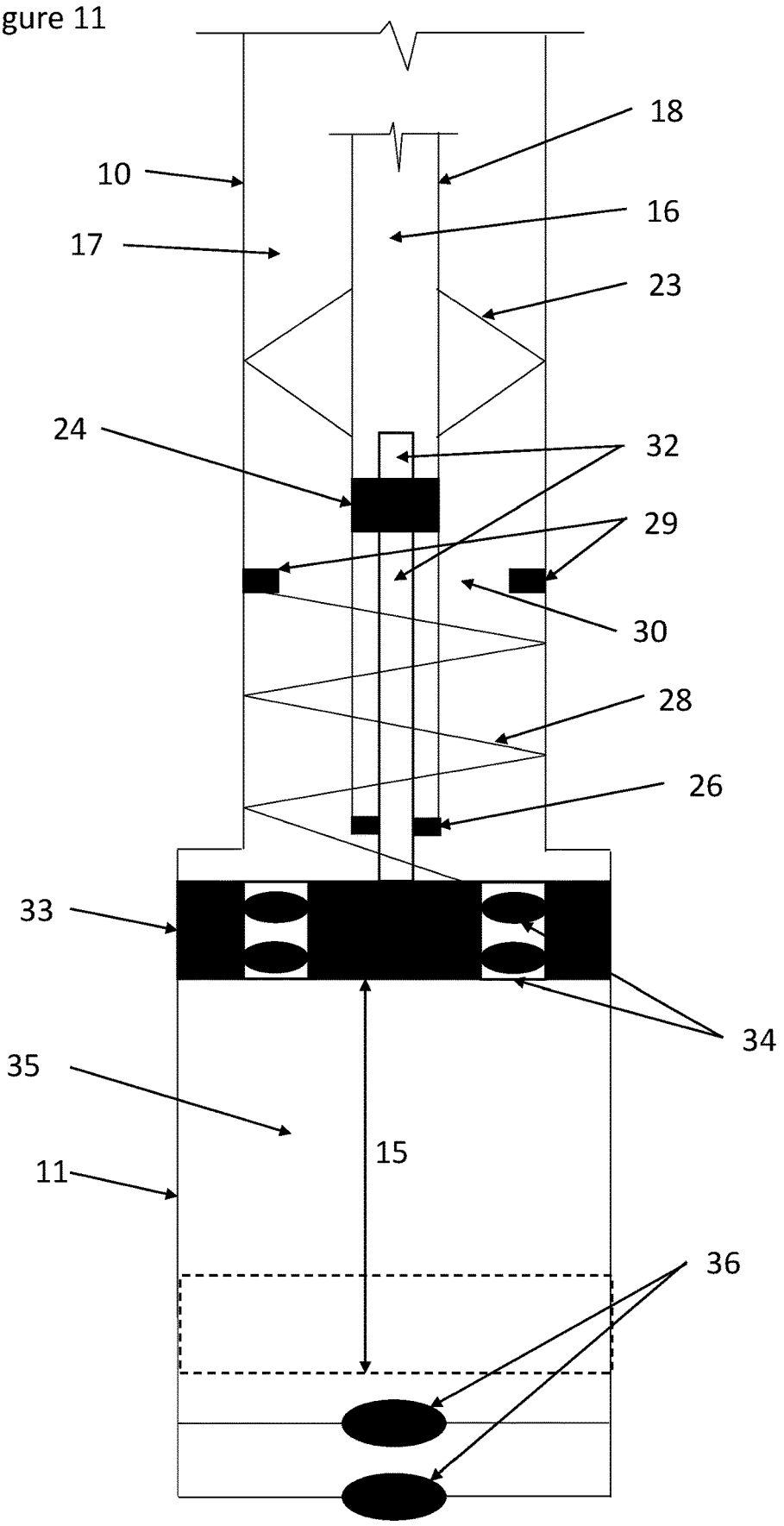
FIG. 11 shows a cross-sectional side view of a hydraulic pump rod hydraulically connected to a lower displacement body which is mechanically connected to a pump shaft which again is mechanically connected to a pump piston in a reciprocating downhole pump. Above the pump piston, a kinetic energy storing unit is installed.

FIG. 11 shows a principle sketch of cross-sectional side view of a hydraulic pump rod (liquid) 16 and a device exemplified as a reciprocating downhole pump 11. In this FIG. 11 the hydraulic pump rod 16 is hydraulically connected to a lower displacement body 24 which again is mechanically connected to a lower rod exemplified as a pump shaft 32. The pump shaft 32 is mechanically connected to a pump piston 33 which is equipped with two sets of travelling valves 34. The pump shaft 32 may be (not shown in FIG. 11) connected to any type of a reciprocating downhole pump 11. When the hydraulic pump rod 16, the lower displacement body 24 and the pump shaft 32 reciprocates up and down also the pump piston 33 moves up and down a given stroke length 15. The stroke length 15 is determined by the stroke length of the surface machinery, e.g. surface mounted reciprocating pump unit (not shown in FIG. 11). As the pump piston 33 moves down, the travelling valves 34 open while the standing valves 36 at the bottom of the reciprocating downhole pump 11, i.e. at the bottom of the pump cylinder 35, are closed. Thus, the wellbore fluids in the pump cylinder 35 is forced from the bottom side of the pump piston 33 to the top side of the pump piston 33. Then, when the pump piston 33 moves upward, the traveling valves 34 are closed forcing the wellbore fluids in the pump cylinder 35, and thereby also above the pump piston 33, into the annular production area 17. At the same time the standing valves 36 open and allow a new volume of wellbore fluids from outside the reciprocating downhole pump 11 to enter the pump cylinder 35 below the pump piston 33. In this FIG. 11 the hydraulic pipe 18 hung off in the tubing 10 with an anchor 23. Furthermore, in this FIG. 11 the pump piston 33 is equipped with a kinetic energy storing unit 28 in the form of a mechanical spring. The kinetic energy storing unit 28 is located inside the tubing 10, between the top of the pump piston 33 and a floor 29. The floor 29 is equipped with an opening 30 allowing any type of fluids to pass through the floor 29. When the hydraulic pump rod 16, the lower displacement body 24, the pump shaft 32 and the pump piston 33 moves downward, the kinetic energy storing unit 28 is stretched between the floor 29 and the pump piston 33. This stretching is caused by the gravity forces, and this tension is stored in the kinetic energy storing unit 28. When the hydraulic pump rod 16, the lower displacement body 24, the pump shaft 32 and the pump piston 33 move upward caused by the upward movement of the surface mounted reciprocating pump unit (not shown in FIG. 11) the tension generated by the gravity forces and stored in the kinetic energy storing unit 28 is released. This released energy reduces the energy that must be supplied from any surface energy supply system during the upward movement of a surface mounted reciprocating pump unit (not shown in FIG. 11).

Figure 12:
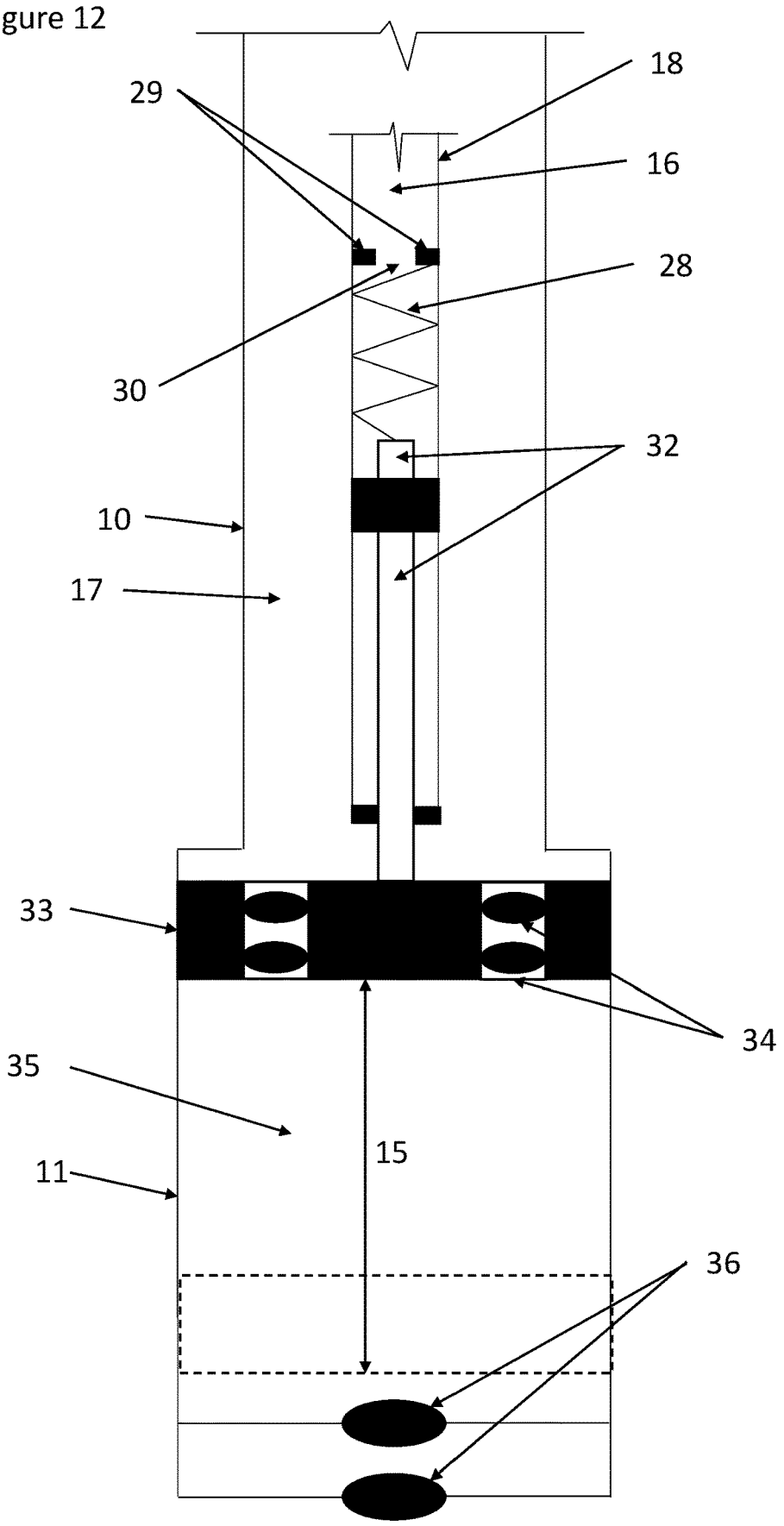
FIG. 12 shows a cross-sectional side view of a hydraulic pump rod hydraulically connected to a lower displacement body which is mechanically connected to a pump shaft which again is mechanically connected to a pump piston in a reciprocating downhole pump. Above the lower displacement body, a kinetic energy storing unit is installed.

FIG. 12 shows a principle sketch of cross-sectional side view of a hydraulic pump rod (liquid) 16 and a device exemplified as a reciprocating downhole pump 11. In this FIG. 12 the hydraulic pipe 18 is equipped with a floor 29 and a kinetic energy storing unit 28. The floor 29 is equipped with an opening 30 which allows the hydraulic pump rod 16 to move passed the floor 29 when the hydraulic pump rod 16 reciprocates. When the hydraulic pump rod 16 and thereby also the pump piston 33 moves downward, the kinetic energy storing unit 28, which in this FIG. 12 is in the form of a mechanical spring, is stretched between the floor 29 and the pump shaft 32. This stretching is caused by the gravity forces, and this tension is stored in the kinetic energy storing unit 28. When the hydraulic pump rod 16, the pump shaft 32 and the pump piston 33 move upward caused by the upward movement of the surface mounted reciprocating pump unit (not shown in FIG. 12) the tension generated by the gravity forces and stored in the kinetic energy storing unit 28 is released. This released energy reduces the energy that must be supplied from any surface energy supply system during the upward movement of a surface mounted reciprocating pump unit (not shown in FIG. 12).

Figure 13:
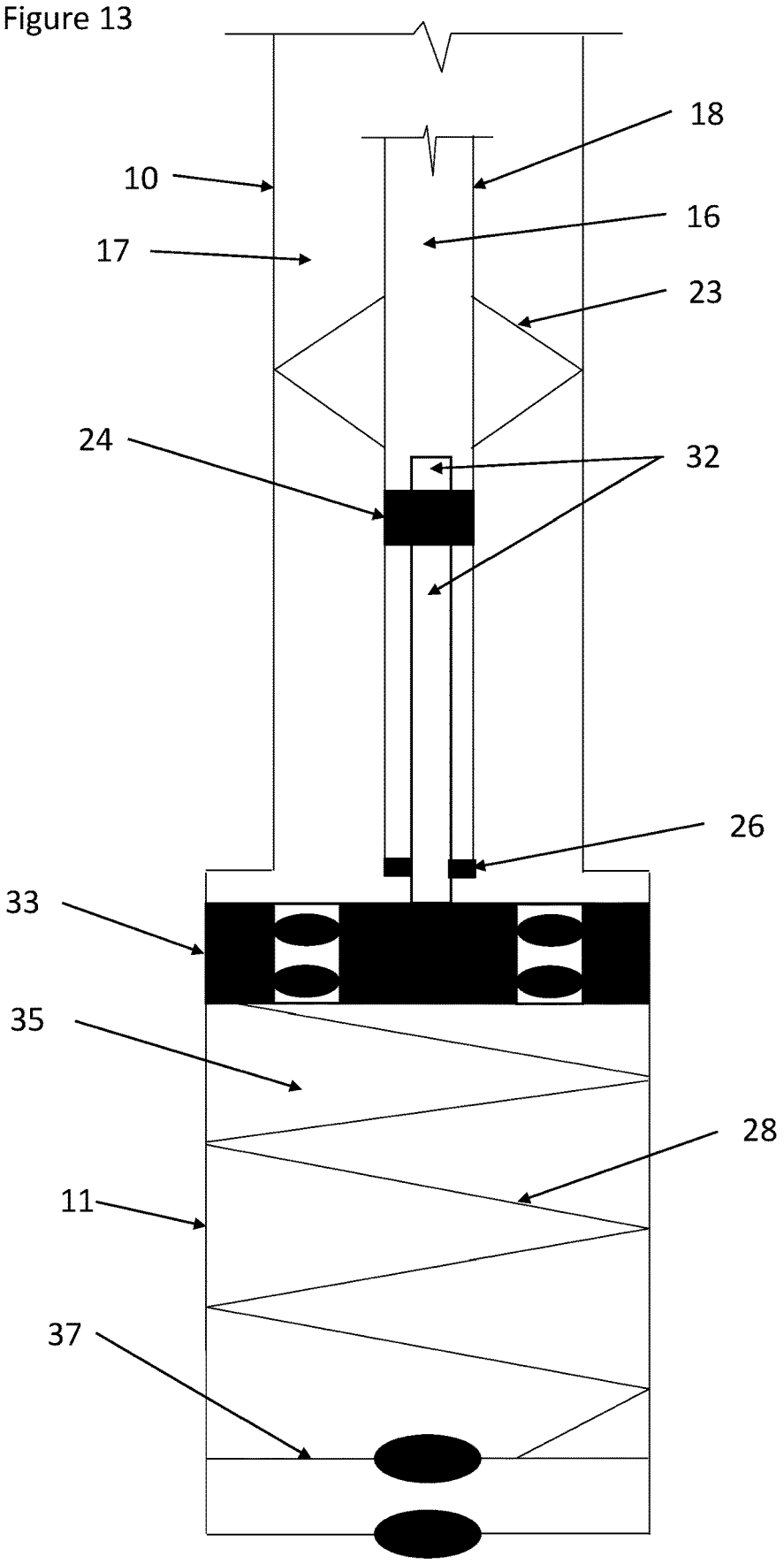
FIG. 13 shows a cross-sectional side view of a hydraulic pump rod hydraulically connected to a lower displacement body which is mechanically connected to a pump shaft which again is mechanically connected to a pump piston in a reciprocating downhole pump. Below the pump piston in the reciprocating downhole pump, a kinetic energy storing unit is installed.

FIG. 13 shows a principle sketch of cross-sectional side view of a hydraulic pump rod (liquid) 16 and a device exemplified as a reciprocating downhole pump 11. In this FIG. 13 the pump cylinder 35 is equipped with a kinetic energy storing unit 28. When the hydraulic pump rod 16 and thereby also the pump piston 33 moves downward, the kinetic energy storing unit 28, which in this FIG. 13 is in the form of a mechanical spring, is compressed between the internal bottom 37 of the reciprocating downhole pump 11 and the pump piston 33. When the hydraulic pump rod 16, lower displacement body 24, the pump shaft 32 and the pump piston 33 move downward, the kinetic energy storing unit 28 is compressed towards the internal bottom 37 of the reciprocating downhole pump 11. This compression is caused by the gravity forces, and the compression energy is stored in the kinetic energy storing unit 28. When the hydraulic pump rod 16, lower displacement body 24, the pump shaft 32 and the pump piston 33 move upward caused by the upward movement of the surface mounted reciprocating pump unit (not shown in FIG. 13) the compression generated by the gravity forces and stored in the kinetic energy storing unit 28 is released. This released energy reduces the energy that must be supplied from any surface energy supply system during the upward movement of a surface mounted reciprocating pump unit (not shown in FIG. 13).

Figure 14:
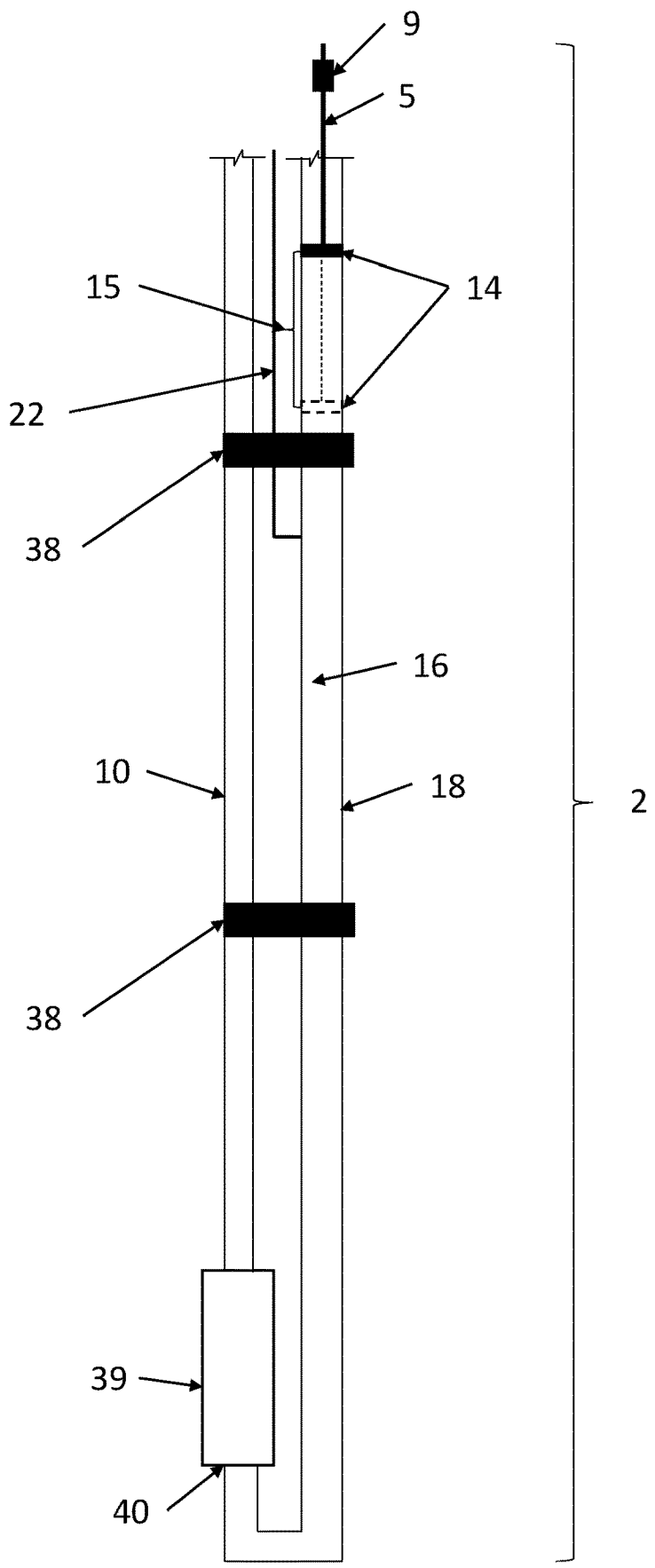
FIG. 14 shows a cross-sectional side view of section of a subterranean vertical well equipped with a tubing, a hydraulic pump rod and a hydraulic pipe which is connected to the bottom of an inverted reciprocating downhole pump.

FIG. 14 shows a principle sketch of cross-sectional side view of a section of a subterranean vertical well 2 equipped with a tubing 10, a hydraulic pump rod (liquid) 16 and a hydraulic pipe 18. In this FIG. 14 the hydraulic pipe 18 is terminated downhole in a subterranean vertical well 2 with a bottom connection 40 which is attached to a device in the form of an inverted reciprocating downhole pump 39. In order to better disclosing the other components in the apparatus, the lower displacement body 11 is removed from the figure on purpose. Also, in this FIG. 14, the hydraulic pipe 18 and thereby the hydraulic pump rod 16 is running in parallel with the tubing 10, and not concentric. In this FIG. 14 the tubing 10 is fixed together with the hydraulic pipe 18 using one or more clamps 38. The hydraulic pump rod 16 is hydraulically connected to the bottom side of the upper displacement body 14, while the upper displacement body 14 in itself is mechanically connected to the upper rod exemplified as a sucker rod 5. Depending on the depth of the well, there may be more than one joint of sucker rod 5 employed, and then the different joints of sucker rods 5 will be connected to one another by the rod connections 9. Below the stroke length 15 of the upper displacement body 14, the hydraulic pipe 18 is connected to a hydraulic tube 22. At the surface 1 (not shown in FIG. 14) the tubing 10 and the hydraulic pipe 18 will be connected to the wellhead 7 (not shown in. FIG. 14). Both the tubing 10 and the hydraulic pipe 18 will have passages through the X-mass tree 6 (not shown in FIG. 14). The sucker rod 5, will be connected to a surface machinery, e.g. a surface mounted reciprocating pump unit (not shown in FIG. 14). At surface 1 (not shown in FIG. 14) the hydraulic tube 22 will be connected to a hydraulic monitoring and pressure adjustment unit 19 (not shown in FIG. 14).

Figure 15:
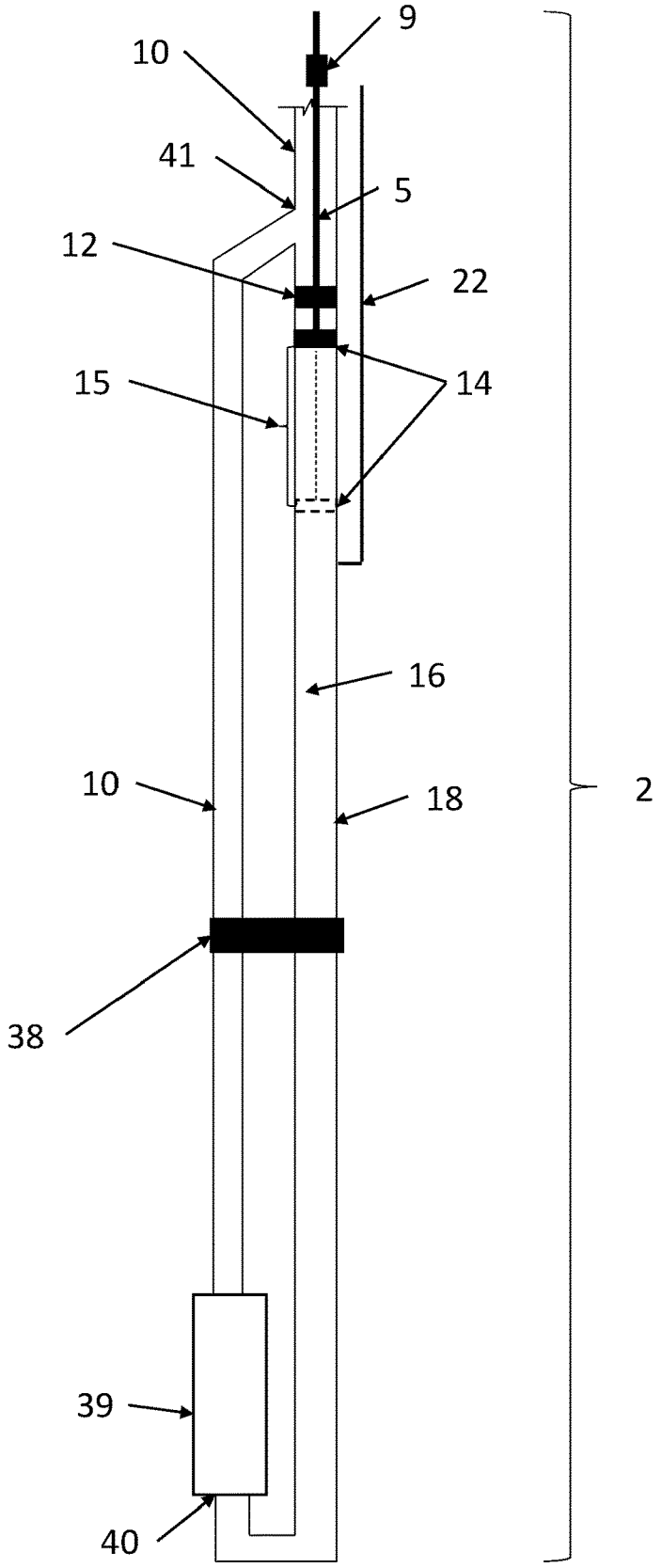
FIG. 15 shows a cross-sectional side view of section of a subterranean vertical well equipped with a tubing, a hydraulic pump rod and a hydraulic pipe which is connected to the bottom of an inverted reciprocating downhole pump. The figure also shows the tubing and the hydraulic pipe being mechanically connected by the use of a Y-connection.

FIG. 15 shows a principle sketch of cross-sectional side view of a section of a subterranean vertical well 2 equipped with a tubing 10, a hydraulic pump rod (liquid) 16 and a hydraulic pipe (longitudinal hollow body) 18. In this FIG. 15 the hydraulic pipe 18 is terminated downhole in a subterranean vertical well 2 with a bottom connection 40 which is attached to a device in the form of an inverted reciprocating downhole pump 39. In order to better disclosing the other components in the apparatus, the lower displacement body 11 is removed from the figure on purpose. Also, in this FIG. 15, the hydraulic pipe 18, and thereby the hydraulic pump rod 16, is running in parallel with the tubing 10, and not concentric, in a section of the subterranean vertical well 2. In this FIG. 15 the tubing 10 is fixed together with the hydraulic pipe 18 using a clamp 38. The hydraulic pump rod 16 is hydraulically connected to the bottom side of the upper displacement body 14, while the upper displacement body 14 is mechanically connected to the upper rod exemplified as sucker rod 5. Depending on the depth of the well, there may be more than one joint of sucker rod 5 employed, and then the different joints of sucker rods 5 will be connected to one another by the rod connections 9. Below the stroke length 15 of the upper displacement body 14, the hydraulic pipe 18 is connected to a hydraulic tube 22. In this FIG. 15 the hydraulic pipe 18 is equipped with an upper downhole stuffing box 12, i.e. a first stuffing box. Also in this FIG. 15, the hydraulic pipe 18 is merged with the tubing 10 using a Y-connection 41. The Y-connection 41 is located above the upper downhole stuffing box 12, and also above the upper displacement body 14. At the surface 1 (not shown in FIG. 15) the tubing 10 is terminated at the wellhead 7 (not shown in FIG. 15). The sucker rod 5 will at the surface (not shown in FIG. 15) be connected to any type of surface machinery such as a surface mounted reciprocating pump unit (not shown in FIG. 15). The hydraulic tube 22 will be connected to a hydraulic monitoring and pressure adjustment unit 19 (not shown in FIG. 14).

Figure 16:
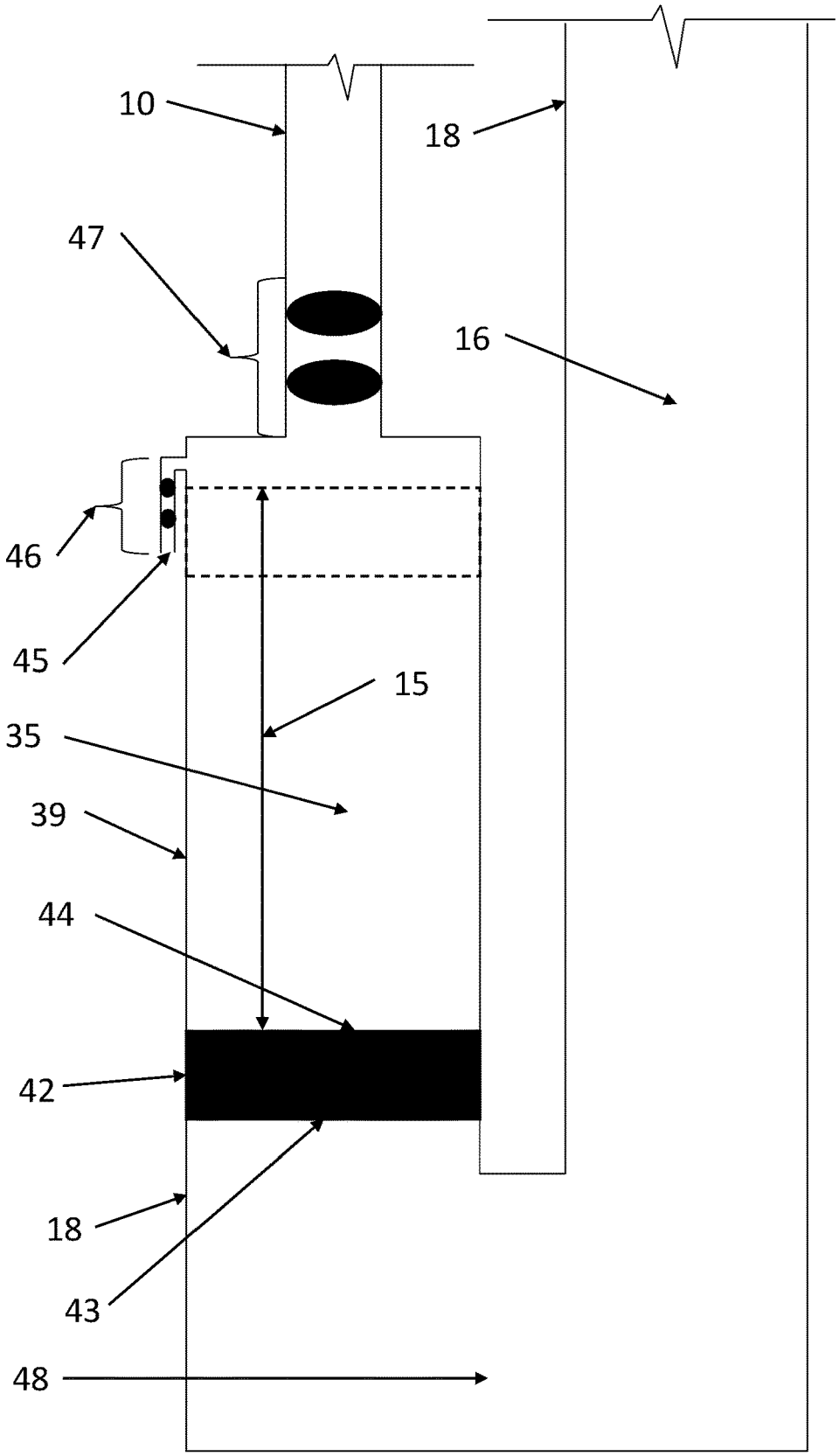
FIG. 16 shows a cross-sectional side view of an inverted reciprocating downhole pump having an inverted pump piston with direct hydraulic drive. I.e. the hydraulic pump rod is hydraulically connected to the pump piston. The figure also shows the radial standing valves mounted on the outside of the inverted reciprocating downhole pump.

FIG. 16 shows a principle sketch of cross-sectional side view of a device exemplified as an inverted reciprocating downhole pump 39 having a pump piston 42 with direct hydraulic drive, i.e. the hydraulic pump rod (liquid) 16 is in hydraulically connected to the hydraulic side 43 of the inverted pump piston 42. In this FIG. 16 the hydraulic pipe (longitudinal hollow body) 18 is connected to the bottom side of the inverted reciprocating downhole pump 39. The inverted reciprocating downhole pump 39 is equipped with two sets of standing valves. The radial standing valves 46 has a radial pump intake 45 through which the wellbore fluids are taken into the pump cylinder 35. The inverted standing valves 47 separates the inverted reciprocating downhole pump 39 from the tubing 10, and the produced wellbore fluids are passing through the inverted standing valves 47 as the produced wellbore fluids are lifted to the surface 1 (not shown in FIG. 16). As the hydraulic pump rod 16 reciprocates, the inverted pump piston 42 has a stroke length 15 which is similar to the stroke length of a surface mounted reciprocating pump unit (not shown in FIG. 16). When the hydraulic pump rod 16 moves downward inside the hydraulic pipe 18, the hydraulic pump rod 16 moves through a bend 48 (U-turn) in the hydraulic pipe 18 which turns the direction of the hydraulic pipe 180°, hence the downward movement of the hydraulic pump rod 16 causes and upward movement of the inverted pump piston 42. When the inverted pump piston 42 moves upward, it moves the produced wellbore fluids from the pump cylinder 35 up through the inverted standing valves 47 and into the tubing 10. During this upward movement of the inverted pump piston 42, the radial standing valves 46 are pushed to a closed position by the fluid pressure generated inside the pump cylinder 35 as the inverted pump piston 42 moves upward. This same fluid pressure inside the pump cylinder 35 is also causing the inverted standing valves 47 to open and let the produced wellbore fluids enter into the tubing 10. When a surface mounted reciprocating pump unit (not shown in FIG. 16) causes the hydraulic pump rod 16 to move upward inside the hydraulic pipe 18, the hydraulic pump rod 16 moves through a bend 48 which turns its direction 180°. Hence, the upward movement of the hydraulic pump rod 16 causes a downward movement of the inverted pump piston 42. When the inverted pump piston 42 moves downward, the hydrostatic pressure inside the tubing 10 causes the inverted standing valves 47 to close, hence the produced wellbore fluids inside the tubing 10 cannot flow back into the pump cylinder 35. Also, when the inverted pump piston 42 moves downward, the hydrostatic pressure caused by the wellbore fluids in any subterranean well (not shown in FIG. 16) outside the inverted reciprocating downhole pump 39, forces the radial standing valves 46 to open and let wellbore fluids pass through the radial pump intake 45 and into the pump cylinder 35.

Figure 17:
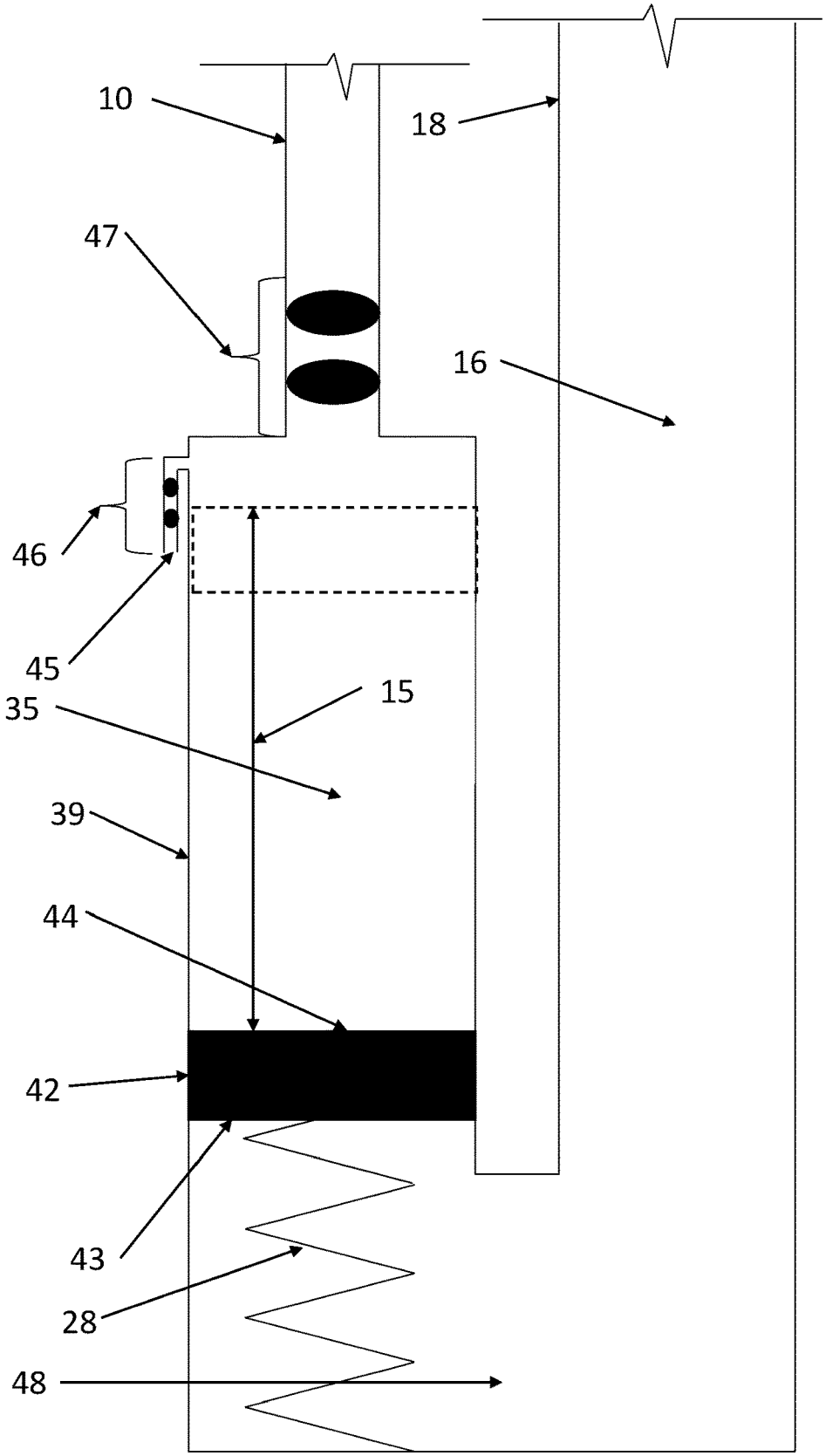
FIG. 17 shows a cross-sectional side view of an inverted reciprocating downhole pump having an inverted pump piston with direct hydraulic drive. I.e. the hydraulic pump rod is hydraulically connected to the pump piston. The figure also shows the radial standing valves mounted on the outside of the inverted reciprocating downhole pump. The figure also shows that the bottom side of the inverted pump piston is equipped with a kinetic energy storing unit.

FIG. 17 shows a principle sketch of cross-sectional side view of a device exemplified as an inverted reciprocating downhole pump 39 having a pump piston 42 with direct hydraulic drive, i.e. the hydraulic pump rod (liquid) 16 is hydraulically connected to the hydraulic side 43 of the inverted pump piston 42. In this FIG. 17 the inverted reciprocating downhole pump 39 is equipped with a kinetic energy storing unit 28. The kinetic energy storing unit 28 is charged when the inverted pump piston 42 moves upward, and its energy is released when the inverted pump piston moves downward. The kinetic energy storing unit 28 is in FIG. 17 placed below the inverted pump piston 42 and thereby connected to the hydraulic side 43 of the inverted pump piston 42. The bottom of the kinetic energy storing unit 28 is in this FIG. 17 placed inside the hydraulic pipe 18.

Figure 18:
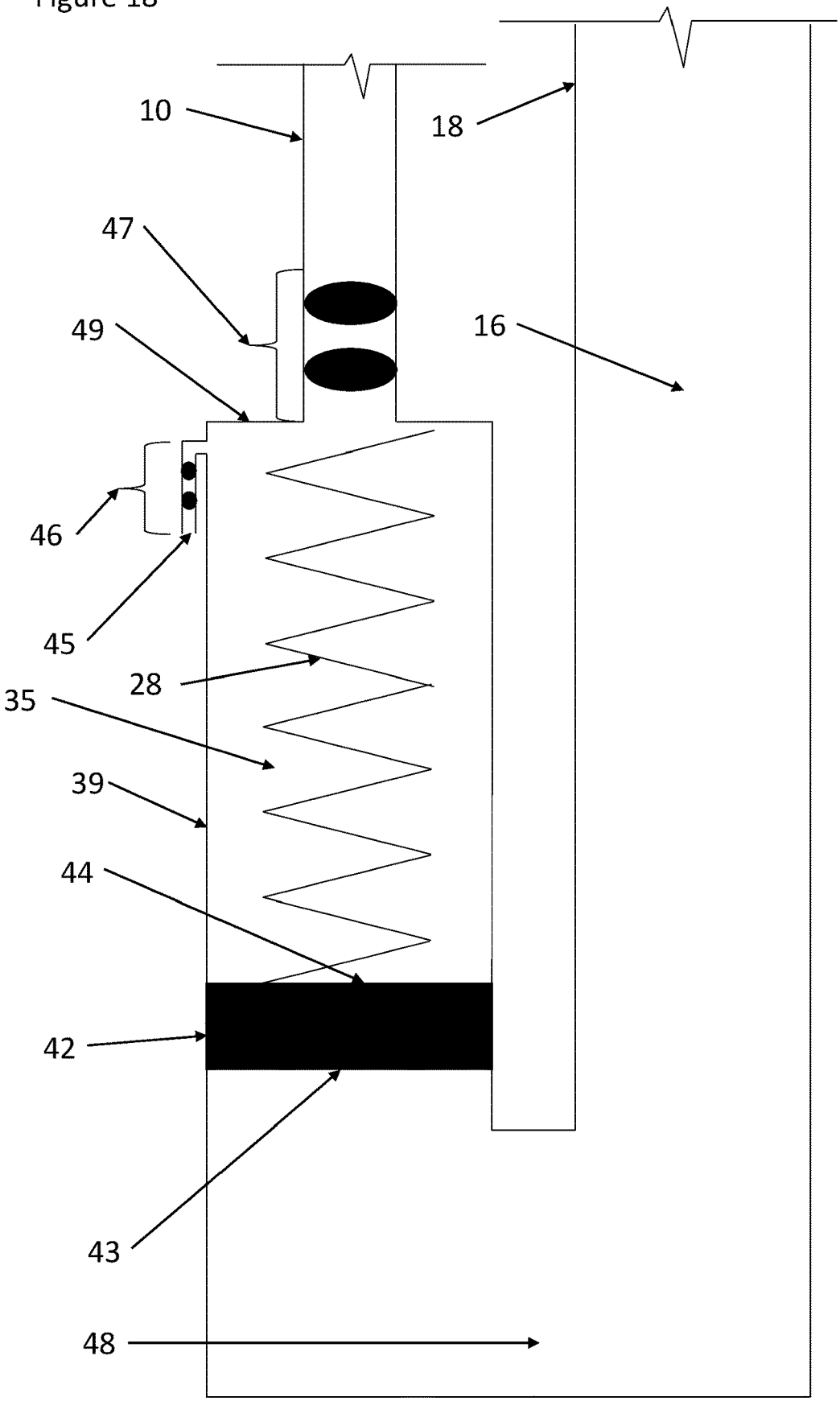
FIG. 18 shows a cross-sectional side view of an inverted reciprocating downhole pump having an inverted pump piston with direct hydraulic drive. I.e. the hydraulic pump rod is hydraulically connected to the pump piston. The figure also shows the radial standing valves mounted on the outside of the inverted reciprocating downhole pump. The figure also shows that the pump side of the inverted pump piston is equipped with a kinetic energy storing unit.

FIG. 18 shows a principle sketch of cross-sectional side view of a device exemplified as an inverted reciprocating downhole pump 39 having a pump piston 42 with direct hydraulic drive, i.e. the hydraulic pump rod (liquid) 16 is in hydraulically connected to the hydraulic side 43 of the inverted pump piston 42. In this FIG. 18, the inverted reciprocating downhole pump 39 is equipped with a kinetic energy storing unit 28. The kinetic energy storing unit 28 is charged when the inverted pump piston 42 moves upward, and its energy is released when the inverted pump piston 42 moves downward. The kinetic energy storing unit 28 is in this FIG. 18 placed on the pump side 44 of the inverted pump piston 42. The top of the kinetic energy storing unit 28 is in this FIG. 18 placed at the top 49 of the pump cylinder 35.

Figure 19:
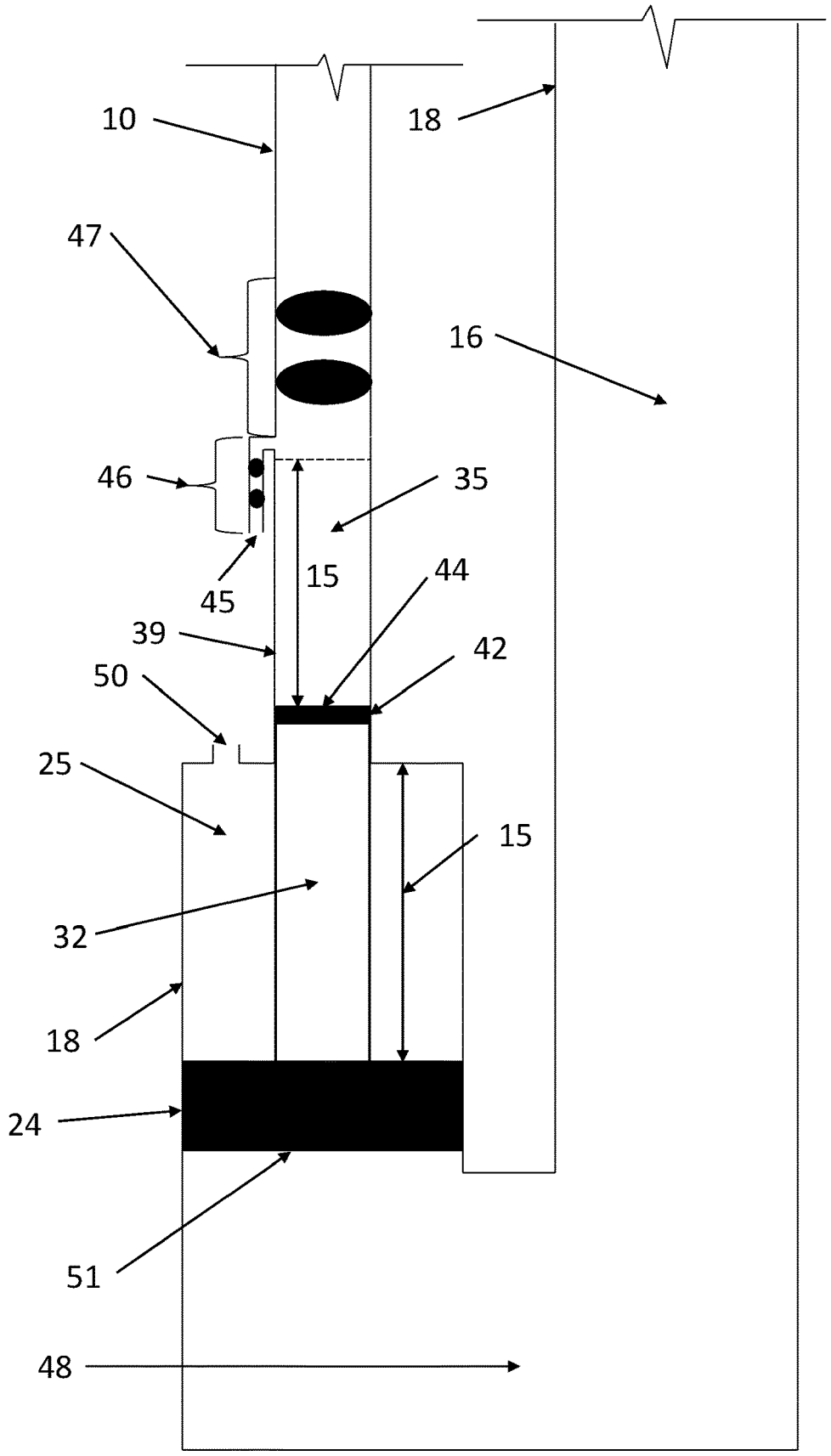
FIG. 19 shows a cross-sectional side view of an inverted reciprocating downhole pump where the inverted pump piston, which has an indirect hydraulic drive mechanism, is mechanically connected to a pump shaft which again is mechanically connected to a lower displacement body. The lower displacement body is equipped with a lower stroke volume which is equipped with an inlet/outlet for wellbore fluids.

FIG. 19 shows a principle sketch of a cross-sectional side view of a device exemplified as an inverted reciprocating downhole pump 39, where the inverted pump piston 42 is mechanically connected to a pump shaft 32 which again is mechanically connected to a lower displacement body 24. The lower displacement body 24 is hydraulically connected to the hydraulic pump rod (liquid) 16 which is placed inside the hydraulic pipe (longitudinal hollow body) 18. The hydraulic pipe 18 is equipped with a 180° bend (U-turn) 48. In this FIG. 19 the invention the inverted pump piston 42 has a pressure area of the pump side 44 which is smaller than the pressure area 51 of the lower displacement body 24. In this FIG. 19 the hydraulic pipe 18 is connected to the bottom side of the inverted reciprocating downhole pump 39. The inverted reciprocating downhole pump 39 is equipped with two sets of standing valves. The radial standing valves 46 has a radial pump intake 45 through which the wellbore fluids from any subterranean well are taken into the pump cylinder 35. The inverted standing valves 47 separates the inverted reciprocating downhole pump 39 from the tubing 10, and the produced wellbore fluids are passing through the inverted standing valves 47 as the produced wellbore fluids are lifted to the surface 1 (not shown in FIG. 19). As the hydraulic pump rod 16 reciprocates, the inverted pump piston 42 and the lower displacement body 24 have stroke lengths 15 which are similar to the stroke length of a surface mounted reciprocating pump unit (not shown in FIG. 19). When the hydraulic pump rod 16 moves downward inside the hydraulic pipe 18, the hydraulic pump rod 16 moves through a bend 48 in the hydraulic pipe 18 which turns its direction 180°, hence the downward movement of the hydraulic pump rod 16 causes and upward movement of lower displacement body 24 and the pump shaft 32 and thereby also the inverted pump piston 42. When the inverted pump piston 42 moves upward, it moves the produced wellbore fluids from the pump cylinder 35 up through the inverted standing valves 47 and into the tubing 10. During this upward movement of the inverted pump piston 42, the radial standing valves 46 are pushed to a closed position by the fluid pressure generated inside the pump cylinder 35 as the inverted pump piston 42 moves upward. This same fluid pressure inside the pump cylinder 35 is also causing the inverted standing valves 47 to open and let the produced wellbore fluids enter into the tubing 10. When a surface mounted reciprocating pump unit (not shown in FIG. 19) causes the hydraulic pump rod 16 to move upward inside the hydraulic pipe 18, the hydraulic pump rod 16 moves through a bend 48 which turns its direction 180°. Hence, the upward movement of the hydraulic pump rod 16 causes a downward movement of the lower displacement body 24, the pump shaft 32 and inverted pump piston 42. When the inverted pump piston 42 moves downward, the hydrostatic pressure inside the tubing 10 causes the inverted standing valves 47 to close, hence the produced wellbore fluids inside the tubing 10 cannot flow back into the pump cylinder 35. Also, when the inverted pump piston 42 moves downward, the hydrostatic pressure caused by the wellbore fluids in any subterranean well (not shown in FIG. 19) outside the inverted reciprocating downhole pump 39, forces the radial standing valves 46 to open and let wellbore fluids pass through the radial pump intake 45 and into the pump cylinder 35. When the hydraulic pump rod 16 hydraulically forces the lower displacement body 34 to move up and down, the lower stroke volume 25 must not be allowed to build up a pressure, hence this lower stroke volume 25 is equipped with inlet/outlet 50 for wellbore fluids.

Figure 20:
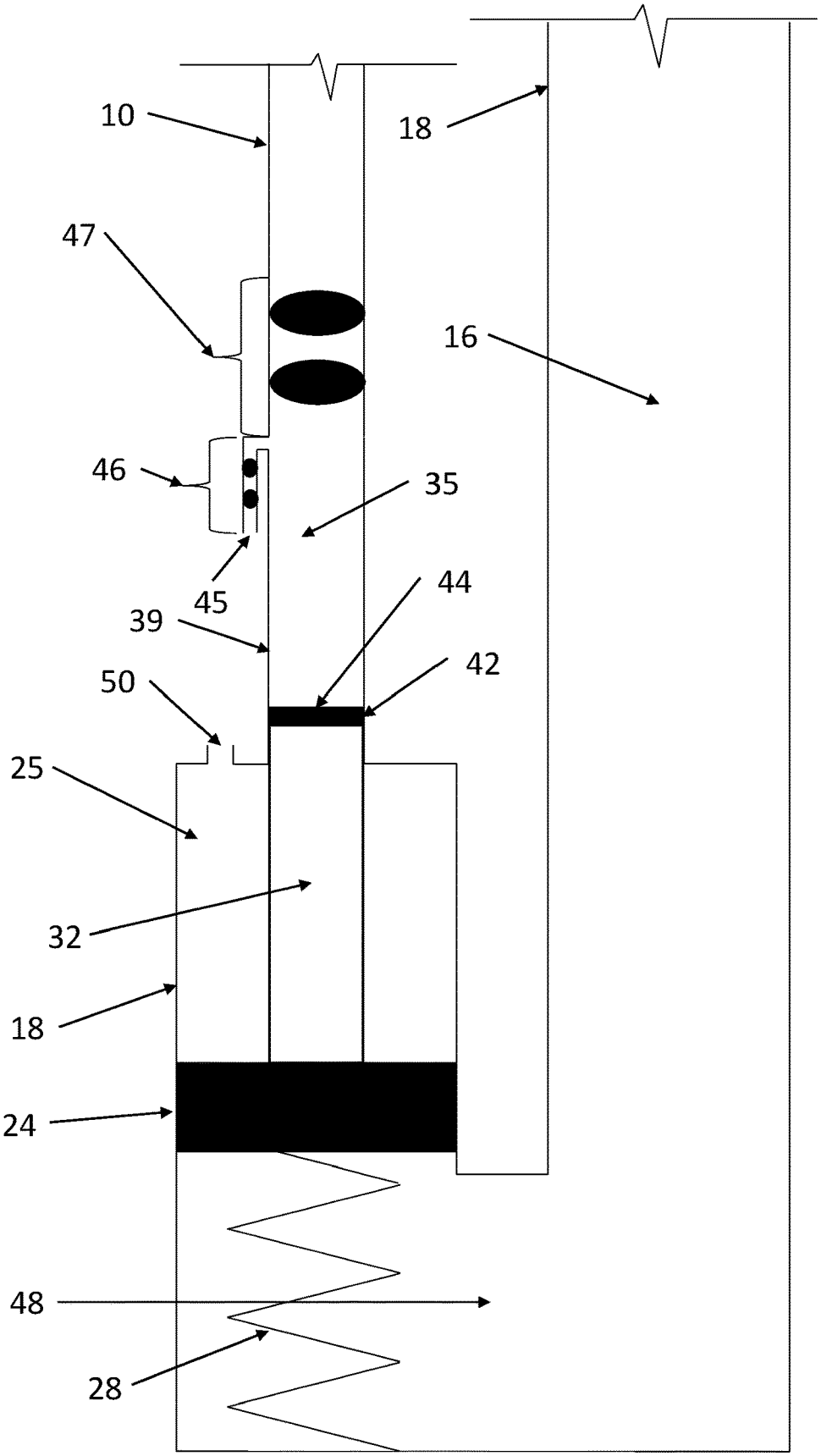
FIG. 20 shows a cross-sectional side view of an inverted reciprocating downhole pump where the inverted pump piston, which has an indirect hydraulic drive mechanism, is mechanically connected to a pump shaft which again is mechanically connected to a lower displacement body. The lower displacement body is equipped with a lower stroke volume which is equipped with an inlet/outlet for wellbore fluids. Below the lower displacement body, i.e. at the hydraulic side of the lower displacement body, is installed a kinetic energy storing unit.

FIG. 20 shows a principle sketch of a cross-sectional side view of a device exemplified as an inverted reciprocating downhole pump 39 where the inverted pump piston 42 is mechanically connected to a lower rod exemplified as a pump shaft 32 which again is mechanically connected to a lower displacement body 24. The lower displacement body 24 is hydraulically connected to the hydraulic pump rod (liquid) 16 which is placed inside the hydraulic pipe (hollow longitudinal body) 18. In this FIG. 20 the inverted reciprocating downhole pump 39 is equipped with a kinetic energy storing unit 28. The kinetic energy storing unit 28 is charged when the lower displacement body 24 moves upward, and its energy is released when the lower displacement body 24 moves downward. The kinetic energy storing unit 28 is in this FIG. 20 placed below the lower displacement body 24 inside the hydraulic pipe 18.

Figure 21:
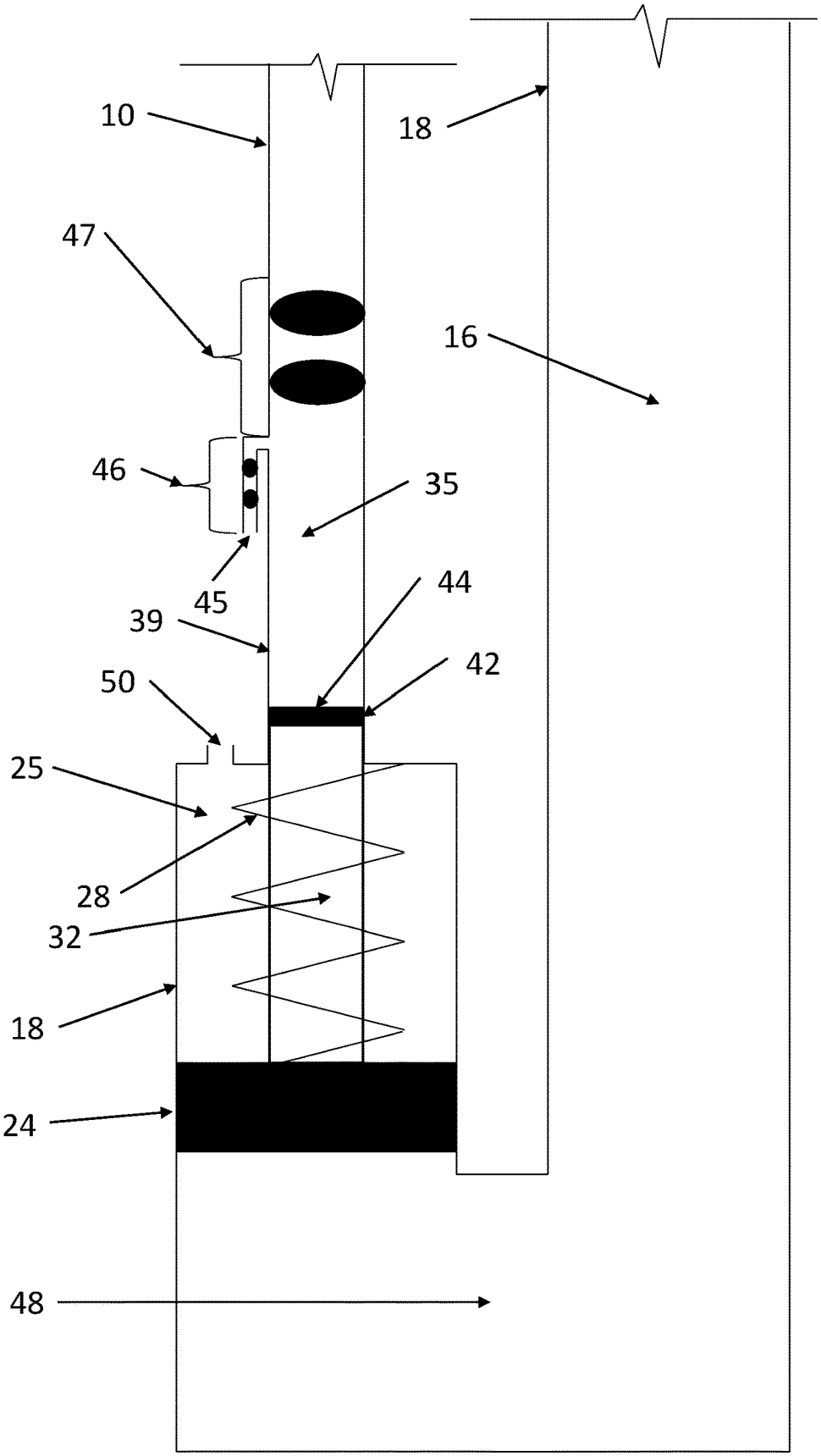
FIG. 21 shows a cross-sectional side view of an inverted reciprocating downhole pump where the inverted pump piston, which has an indirect hydraulic drive mechanism, is mechanically connected to a pump shaft which again is mechanically connected to a lower displacement body. The lower displacement body is equipped with a lower stroke volume which is equipped with an inlet/outlet for wellbore fluids. Inside the lower stroke volume is installed a kinetic energy storing unit.

FIG. 21 shows a principle sketch of a cross-sectional side view of a device exemplified as an inverted reciprocating downhole pump 39 where the inverted pump piston 42 is mechanically connected to a lower rod exemplified as a pump shaft 32 which again is mechanically connected to a lower displacement body 24. The lower displacement body 24 is hydraulically connected to the hydraulic pump rod (liquid) 16 which is placed inside the hydraulic pipe (hollow longitudinal body) 18. In this FIG. 21 the inverted reciprocating downhole pump 39 is equipped with a kinetic energy storing unit 28. The kinetic energy storing unit 28 is charged when the lower displacement body 24 moves upward, and its energy is released when the lower displacement body 24 moves downward. The kinetic energy storing unit 28 is in this FIG. 21 placed in the lower stroke volume 25.

Figure 22:
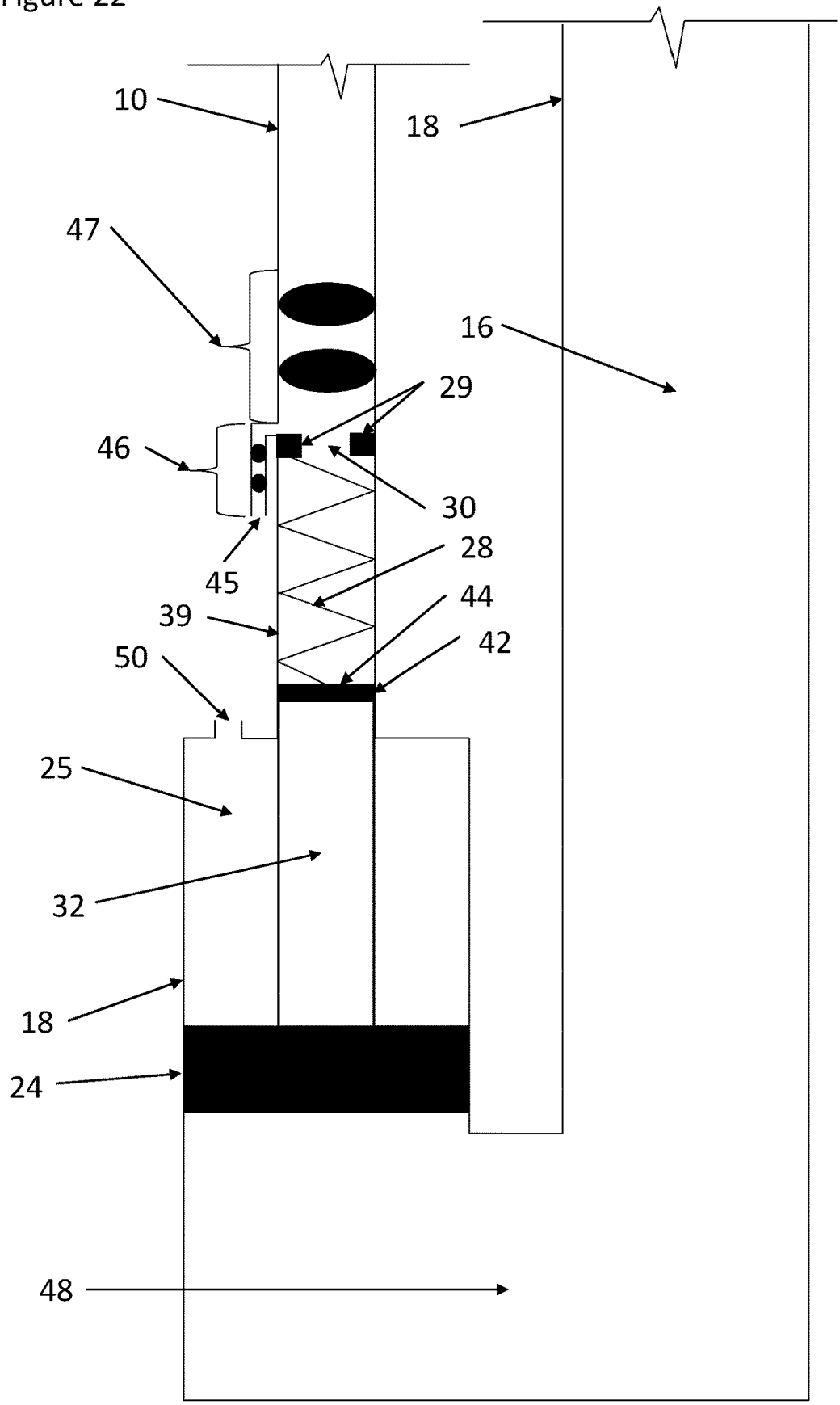
FIG. 22 shows a cross-sectional side view of an inverted reciprocating downhole pump where the inverted pump piston, which has an indirect hydraulic drive mechanism, is mechanically connected to a pump shaft which again is mechanically connected to a lower displacement body. The lower displacement body is equipped with a lower stroke volume which is equipped with an inlet/outlet for wellbore fluids. Above the inverted pump piston and below the radial standing valves is installed a kinetic energy storing unit.

FIG. 22 shows a principle sketch of a cross-sectional side view of a device exemplified as an inverted reciprocating downhole pump 39 where the inverted pump piston 42 is mechanically connected to lower rod exemplified as a pump shaft 32 which again is mechanically connected to a lower displacement body 24. The lower displacement body 24 is hydraulically connected to the hydraulic pump rod (liquid) 16 which is placed inside the hydraulic pipe (hollow longitudinal body) 18. In this FIG. 22 the inverted reciprocating downhole pump 39 is equipped with a kinetic energy storing unit 28. The kinetic energy storing unit 28 is charged when the lower displacement body 24 moves upward, and its energy is released when the lower displacement body 24 moves downward. The kinetic energy storing unit 28 is in this FIG. 22 placed inside the inverted reciprocating downhole pump 39. The top of the kinetic energy storing unit 28 is placed on a floor 29 and at the top of the inverted pump piston 42. The floor 29 is equipped with an opening 30 which allows the produced wellbore fluids to pass through the floor 29 with minimum flow restriction and thereafter into the tubing 10.

Figure 23:
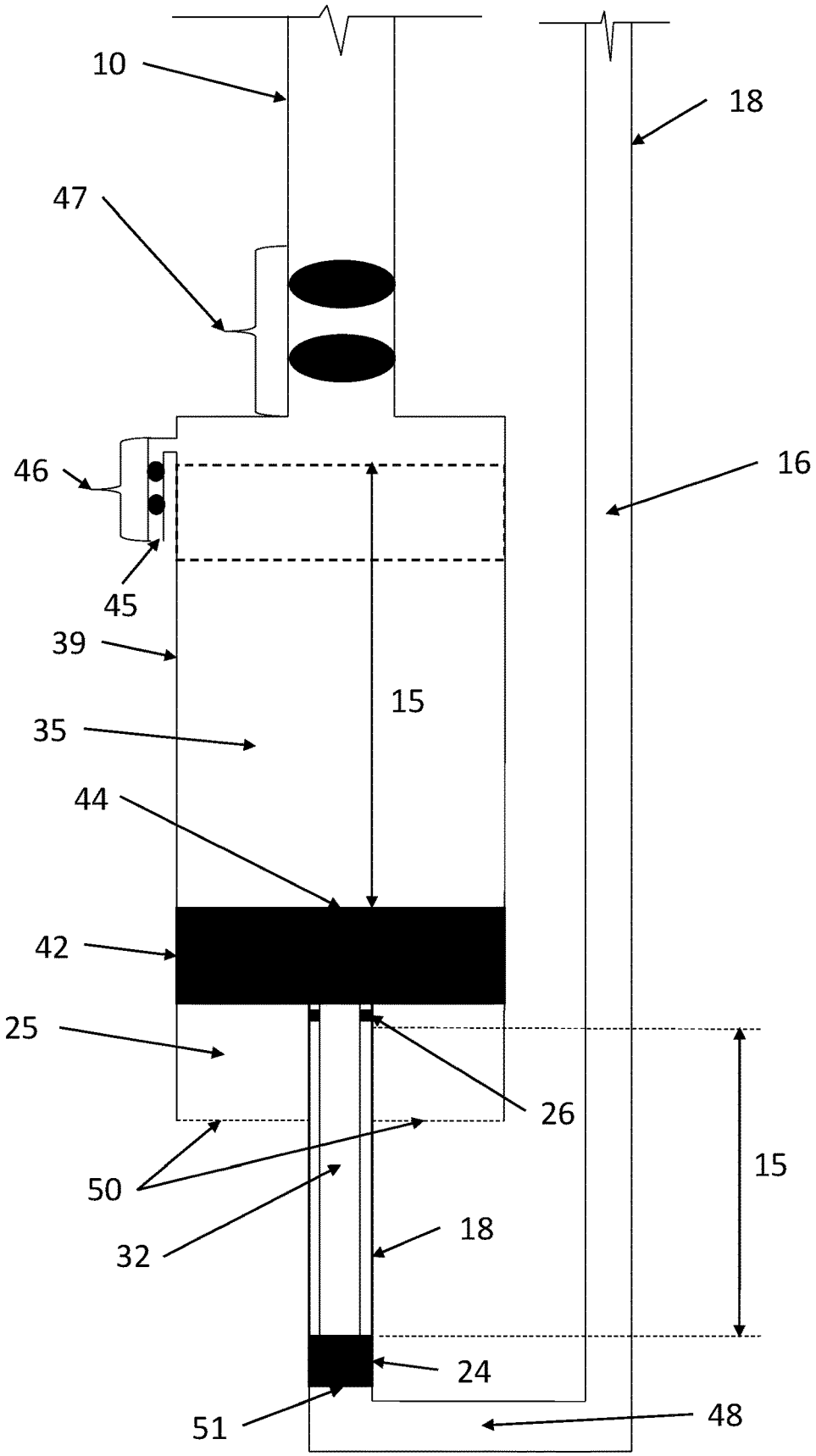
FIG. 23 shows a cross-sectional side view of an inverted reciprocating downhole pump where the inverted pump piston, with indirect hydraulic drive, is mechanically connected to a pump shaft which is mechanically connected to a lower displacement body which is hydraulically connected to the hydraulic pump rod. Below the inverted pump piston is a lower stroke volume with an inlet/outlet for wellbore fluids.

FIG. 23 shows a principle sketch of a cross-sectional side view of a device exemplified as an inverted reciprocating downhole pump 39, where the inverted pump piston 42 is mechanically connected to a lower rod exemplified as a pump shaft 32 which sits inside a section of the hydraulic pipe (hollow longitudinal body) 18 and in this FIG. 23 the pump shaft 32 is equipped with a lower downhole stuffing box 26, i.e. a first or second stuffing box. Furthermore, the pump shaft 32 is mechanically connected to a lower displacement body 24. The lower displacement body 24 is hydraulically connected to the hydraulic pump rod 16 which is placed inside the hydraulic pipe 18. In this FIG. 23 the inverted pump piston 42 has a pressure area of the pump side 44 which is larger than the pressure area 51 of the lower displacement body 24. In this FIG. 23 the hydraulic pipe 18 is connected to the bottom side of the inverted reciprocating downhole pump 39. The inverted reciprocating downhole pump 39 is equipped with two sets of standing valves. The radial standing valves 46 has a radial pump intake 45 through which the wellbore fluids from any subterranean well are taken into the pump cylinder 35. The inverted standing valves 47 separates the inverted reciprocating downhole pump 39 from the tubing 10, and the produced wellbore fluids are passing through the inverted standing valves 47 as the produced wellbore fluids are lifted to the surface 1 (not shown in FIG. 23). As the hydraulic pump rod (liquid) 16 reciprocates, the inverted pump piston 42 and the lower displacement body 24 have stroke lengths 15 which are similar to the stroke length of a surface mounted reciprocating pump unit (not shown in FIG. 23). When the hydraulic pump rod 16 moves downward inside the hydraulic pipe (hollow longitudinal body) 18, the hydraulic pump rod 16 moves through a bend (U-turn) 48 in the hydraulic pipe 18 which turns its direction 180°, hence the downward movement of the hydraulic pump rod 16 causes and upward movement of lower displacement body 24 and the pump shaft 32 and thereby also the inverted pump piston 42. When the inverted pump piston 42 moves upward, it moves the produced wellbore fluids from the pump cylinder 35 up through the inverted standing valves 47 and into the tubing 10. During this upward movement of the inverted pump piston 42, the radial standing valves 46 are pushed to a closed position by the fluid pressure generated inside the pump cylinder 35 as the inverted pump piston 42 moves upward. This same fluid pressure inside the pump cylinder 35 is also causing the inverted standing valves 47 to open and let the produced wellbore fluids enter the tubing 10. When the hydraulic pump rod 16 moves upward inside the hydraulic pipe 18, the hydraulic pump rod 16 moves through a bend 48 which turns its direction 180°, hence the upward movement of the hydraulic pump rod 16 causes a downward movement of the lower displacement body 24, the pump shaft 32 and inverted pump piston 42. When the inverted pump piston 42 moves downward, the hydrostatic pressure inside the tubing 10 causes the inverted standing valves 47 to close, hence the produced wellbore fluids inside the tubing 10 cannot flow back into the pump cylinder 35. Also, when the inverted pump piston 42 moves downward, the hydrostatic pressure caused by the wellbore fluids in any subterranean well (not shown in FIG. 23) outside the inverted reciprocating downhole pump 39, forces the radial standing valves 46 to open and let wellbore fluids pass through the radial pump intake 45 and into the pump cylinder 35. When the hydraulic pump rod 16 hydraulically forces the lower displacement body 34 to move up and down, the lower stroke volume 25 must not be allowed to build up a pressure, hence the lower stroke volume 25 is equipped with inlet/outlet 50 for wellbore fluids, which in this FIG. 23 is in the form of perforations.

Figure 24:
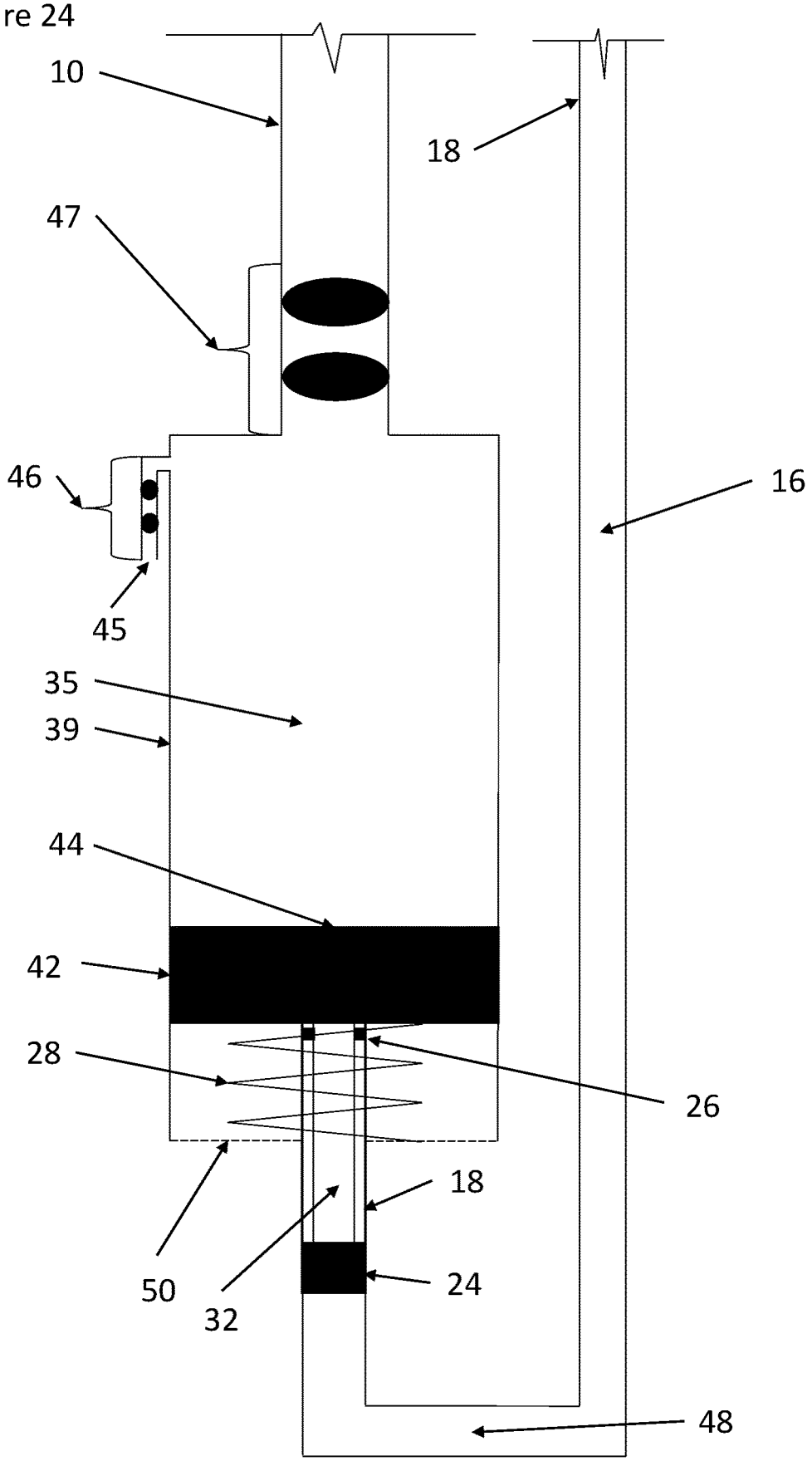
FIG. 24 shows a cross-sectional side view of an inverted reciprocating downhole pump where the inverted pump piston, with indirect hydraulic drive, is mechanically connected to a pump shaft which is mechanically connected to a lower displacement body which is hydraulically connected to the hydraulic pump rod. Below the inverted pump piston is a lower stroke volume with an inlet/outlet for wellbore fluids. Inside the lower stroke volume is installed a kinetic energy storing unit.

FIG. 24 shows a principle sketch of a cross-sectional side view of a device exemplified as an inverted reciprocating downhole pump 39, where the inverted pump piston 42 is mechanically connected to a lower rod exemplified as a pump shaft 32 which sits inside a section of the hydraulic pipe (hollow longitudinal body) 18 and in this embodiment of the invention, the pump shaft 32 is equipped with a lower downhole stuffing box 26. The pump shaft 32 is mechanically connected to a lower displacement body 24. The lower displacement body 24 is hydraulically connected to the hydraulic pump rod (liquid) 16 which is confined inside the hydraulic pipe 18. When the hydraulic pump rod 16 hydraulically forces the lower displacement body 34 to move up and down, the lower stroke volume 25 must not be allowed to build up a pressure, hence this volume is equipped with inlet/outlet 50 for wellbore fluids. In this FIG. 24 the lower stroke volume 25 is equipped with a kinetic energy storing unit 28.

Figure 25:
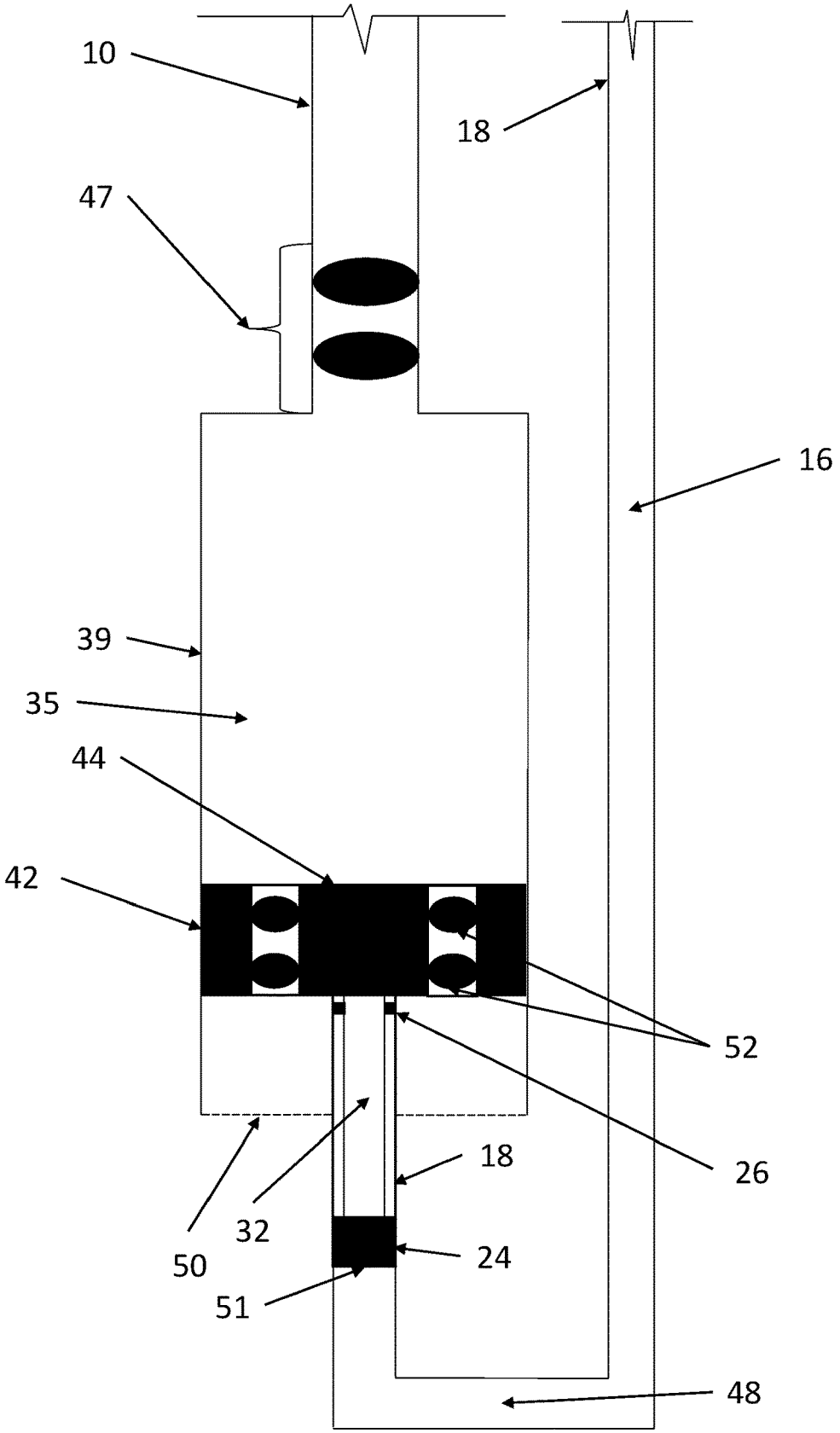
FIG. 25 shows a cross-sectional side view of an inverted reciprocating downhole pump where the inverted pump piston, with indirect hydraulic drive, is mechanically connected to a pump shaft which is mechanically connected to a lower displacement body. The lower displacement body is hydraulically connected to the hydraulic pump rod. The inverted pump piston is equipped with two sets of inverted travelling valves.

FIG. 25 shows a principle sketch of a cross-sectional side view of a device exemplified as an inverted reciprocating downhole pump 39, where the inverted pump piston 42 is mechanically connected to a lower rod exemplified as a pump shaft 32 which sits inside a section of the hydraulic pipe (hollow longitudinal body) 18 and in this FIG. 25 the pump shaft 32 is equipped with a lower downhole stuffing box 26. Furthermore, the pump shaft 32 is mechanically connected to a lower displacement body 24. The lower displacement body 24 is hydraulically connected to the hydraulic pump rod 16 which is placed inside the hydraulic pipe 18. In this FIG. 25 the inverted pump piston 42 is equipped with inverted travelling valves 52. Also in this FIG. 25 the inverted pump piston 42 has a pressure area of the pump side 44 which is larger than the pressure area 51 of the lower displacement body 24. The hydraulic pipe 18 is connected to the bottom side of the inverted reciprocating downhole pump 39, and the inverted reciprocating downhole pump 39 is equipped with one set of inverted standing valves 47. The wellbore fluids from any subterranean well are taken into the pump cylinder 35 through the traveling valves 52 while the inverted standing valves 47 separates the inverted reciprocating downhole pump 39 from the tubing 10. When the hydraulic pump rod (liquid) 16 moves downward inside the hydraulic pipe 18 due to the downward movement of any surface machinery, e.g. surface mounted reciprocating pump unit (not shown in FIG. 25) the hydraulic pump rod 16 moves through a bend (U-turn) 48 in the hydraulic pipe 18 which turns its direction 180°, hence the downward movement of the hydraulic pump rod 16 causes and upward movement of lower displacement body 24 and the pump shaft 32 and thereby also the inverted pump piston 42. When the inverted pump piston 42 moves upward, the inverted traveling valves 52 are closed thus the inverted pump piston 42 moves the produced wellbore fluids from the pump cylinder 35 up through the inverted standing valves 47 and into the tubing 10. During this upward movement of the inverted pump piston 42, the inverted traveling valves 52 are pushed to a closed position by the fluid pressure generated inside the pump cylinder 35. This same fluid pressure inside the pump cylinder 35 is also causing the inverted standing valves 47 to open and let the produced wellbore fluids enter into the tubing 10. When the hydraulic pump rod 16 moves upward inside the hydraulic pipe 18, the hydraulic pump rod 16 moves through a bend 48 which turns its direction 180°, hence the upward movement of the hydraulic pump rod 16 causes a downward movement of the lower displacement body 24, the pump shaft 32 and inverted pump piston 42. When the inverted pump piston 42 moves downward, the hydrostatic pressure inside the tubing 10 causes the inverted standing valves 47 to close, hence the produced wellbore fluids inside the tubing 10 cannot flow back into the pump cylinder 35. Also, when the inverted pump piston 42 moves downward, the hydrostatic pressure outside the inverted reciprocating downhole pump 39, caused by the well bore fluids in any subterranean well, will force the inverted traveling valves 52 to open and let wellbore fluids pass through inverted pump piston 42 and into the pump cylinder 35. When the hydraulic pump rod 16 hydraulically forces the lower displacement body 34 to move up and down, the lower stroke volume 25 must not be allowed to build up a fluid pressure, hence the lower stroke volume 25 is equipped with inlet/outlet 50 for wellbore fluids, which in this FIG. 25 is in the form of perforations.

Figure 26:
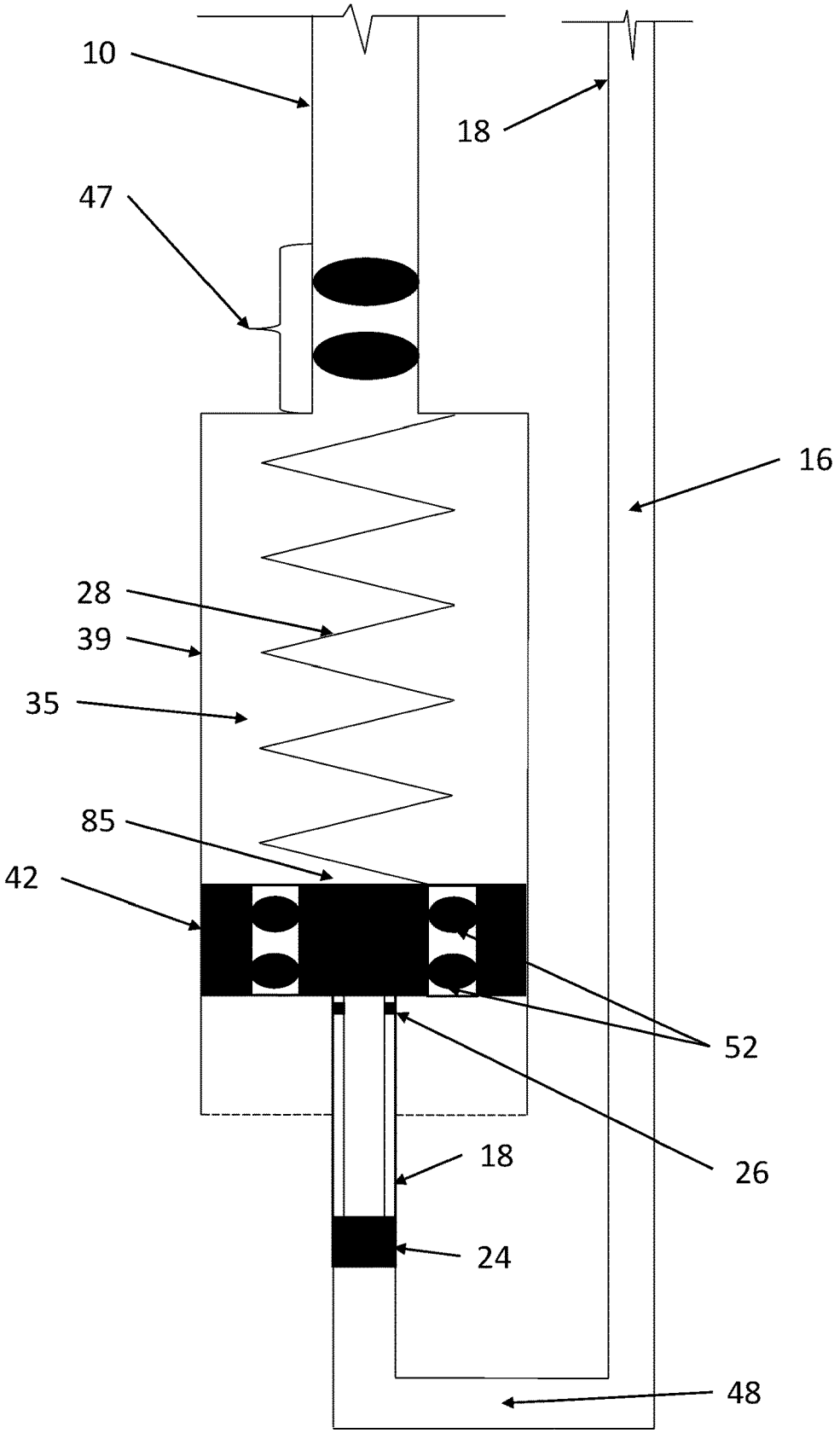
FIG. 26 shows a cross-sectional side view of an inverted reciprocating downhole pump where the inverted pump piston, with indirect hydraulic drive, is mechanically connected to a pump shaft which is mechanically connected to a lower displacement body. The lower displacement body is hydraulically connected to the hydraulic pump rod. The inverted pump piston is equipped with two sets of inverted travelling valves. The figure also shows that the inverted reciprocating downhole pump is equipped with a kinetic energy storing unit.

FIG. 26 shows a principle sketch of a cross-sectional side view of a device exemplified as an inverted reciprocating downhole pump 39, where the inverted pump piston 42 is mechanically connected to a lower rod exemplified as a pump shaft 32 which sits inside a section of the hydraulic pipe 18 and in this FIG. 26 the pump shaft 32 is equipped with a lower downhole stuffing box 26. Furthermore, the pump shaft 32 is mechanically connected to a lower displacement body 24. The lower displacement body 24 is hydraulically connected to the hydraulic pump rod (liquid) 16 which is placed inside the hydraulic pipe (hollow longitudinal body) 18. The inverted pump piston 42 is equipped with inverted travelling valves 52. Also, in this FIG. 26, the inverted pump piston 42 has a pressure area of the pump side 44 which is larger than the pressure area 51 of the lower displacement body 24. In this FIG. 26 the hydraulic pipe 18 is connected to the bottom side of the inverted reciprocating downhole pump 39, and the inverted reciprocating downhole pump 39 is equipped with one set of inverted standing valves 47. In this FIG. 26 the pump cylinder 35 is equipped with a kinetic energy storing unit 28.

Preferred embodiments have now been described and shown. However, the invention is not so limited. Rather, the scope of the invention is defined solely by the scopes of the following claims.

The invention claimed is:

1. An apparatus for transferring a reciprocating movement from a machinery arranged at a surface to a device located downhole in a subterranean well, the apparatus comprising:

a longitudinal hollow body, an upper rod connected to the machinery in one end thereof and to an upper displacement body in another end thereof, a lower displacement body adapted to operate the device, the upper displacement body and the lower displacement body are in communication via a liquid in the longitudinal hollow body, and are movable within the longitudinal hollow body, and wherein the upper displacement body, the lower displacement body and the liquid are configured to reciprocate synchronously relative to the longitudinal hollow body and wherein the apparatus further comprises a hydraulic tube, which hydraulic tube in one end thereof is connected to the longitudinal hollow body and in another end is connected to a hydraulic monitoring and pressure adjustment unit, and wherein the pressure in the liquid can be monitored and adjusted by the hydraulic monitoring and pressure adjustment unit.

2. The apparatus according to claim 1, wherein the upper rod is a sucker rod.

3. The apparatus according to claim 1, wherein the lower displacement body is connected to a lower rod.

4. The apparatus according to claim 1, wherein the apparatus further comprises at least a first stuffing box, and wherein the upper rod runs through the first stuffing box.

5. The apparatus according to claim 3, wherein the apparatus further comprises a second stuffing box, and wherein the lower rod runs through the second stuffing box.

6. The apparatus according to claim 1, wherein the upper displacement body and/or the lower displacement body and/or the upper rod is in connection with a kinetic energy storing unit.

7. The apparatus according to claim 1, wherein the connection between the device and the longitudinal hollow body is equipped with a lower stroke volume and at least one outlet or inlet for communication with surrounding wellbore fluids.

8. Method of producing a wellbore fluid utilizing an apparatus, the apparatus comprises a longitudinal hollow body, an upper rod connected to a machinery in one end thereof and to an upper displacement body in an opposite end, a lower displacement body adapted to operate a device, wherein the apparatus further comprises a hydraulic tube, which hydraulic tube in one end thereof is connected to the longitudinal hollow body and in another end is connected to a hydraulic monitoring and pressure adjustment unit, and wherein the pressure in the liquid can be monitored and adjusted by the hydraulic monitoring and pressure adjustment unit, wherein the method comprises the following steps:

operating the machinery arranged at the surface to cyclically move the upper rod to reciprocate relative the longitudinal hollow body, transferring the reciprocating movement of the upper rod to a reciprocating movement of a liquid in the longitudinal hollow body, transferring the reciprocating movement of the liquid to the lower displacement body and thus the device, wherein the upper displacement body, the lower displacement body and the liquid are configured to reciprocate synchronously relative to the longitudinal hollow body.

* * * * *